US011472189B2

(12) United States Patent
Haga et al.

(10) Patent No.: US 11,472,189 B2
(45) Date of Patent: Oct. 18, 2022

(54) MOUNTING UNIT AND LIQUID EJECTION APPARATUS

(71) Applicant: SEIKO EPSON CORPORATION, Tokyo (JP)

(72) Inventors: Masato Haga, Shiojiri (JP); Taro Takekoshi, Shiojiri (JP); Nanami Sakai, Matsumoto (JP); Akihiko Shiho, Shiojiri (JP); Tomoyuki Miyazawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 33 days.

(21) Appl. No.: 17/117,462

(22) Filed: Dec. 10, 2020

(65) Prior Publication Data

US 2021/0178769 A1 Jun. 17, 2021

(30) Foreign Application Priority Data

Dec. 12, 2019 (JP) ..... JP2019-224350
Jan. 16, 2020 (JP) ..... JP2020-004950

(51) Int. Cl.
*B41J 2/175* (2006.01)
*B41J 2/14* (2006.01)

(52) U.S. Cl.
CPC ..... *B41J 2/1752* (2013.01); *B41J 2/14* (2013.01)

(58) Field of Classification Search
CPC . B41J 2/14; B41J 2/175; B41J 2/17503; B41J 2/17509; B41J 2/1752; B41J 2/17523; B41J 2/185
See application file for complete search history.

(56) References Cited

U.S. PATENT DOCUMENTS 7,806,523 B2 * 10/2010 Seino ..... B41J 2/17553 347/85
9,227,407 B1 * 1/2016 Harada ..... B41J 2/165
2005/0248637 A1 * 11/2005 Seino ..... B41J 2/1752 347/86
2007/0268344 A1 * 11/2007 Anderson ..... B41J 2/1752 347/86
2016/0129692 A1 5/2016 Ono et al.
2019/0118539 A1 4/2019 Toya

FOREIGN PATENT DOCUMENTS

JP 2007-160825 A 6/2007
JP 2016-088016 A 5/2016
JP 2018-030263 A 3/2018
JP 2019-084701 A 6/2019

* cited by examiner

*Primary Examiner* — Anh T Vo
(74) *Attorney, Agent, or Firm* — Workman Nydegger

(57) ABSTRACT

A mounting unit includes a mounting portion to which a liquid container that accommodates a liquid is mounted, in which the mounting portion has a liquid introduction portion that is inserted into the liquid container that is mounted to the mounting portion, and a first receiving portion that is provided below the liquid introduction portion, the first receiving portion has a first recess portion and a second recess portion, the liquid introduction portion extends in a direction opposite to a mounting direction that is a direction in which the liquid container moves when the liquid container is mounted to the mounting portion, and the second recess portion is provided at a position closer to a tip of the liquid introduction portion than the first recess portion is in the mounting direction.

12 Claims, 22 Drawing Sheets

MOUNTING UNIT AND LIQUID EJECTION APPARATUS

The present application is based on, and claims priority from JP Application Serial Number 2019-224350, filed Dec. 12, 2019, and JP Application Serial Number 2020-004950, filed Jan. 16, 2020, the disclosures of which are hereby incorporated by reference herein in their entirety.

BACKGROUND

1. Technical Field

The present disclosure relates to a mounting unit and a liquid ejection apparatus.

2. Related Art

JP-A-2016-88016 discloses a liquid ejection apparatus provided with a mounting unit in which a liquid container that accommodates a liquid is mounted. The mounting unit is provided with a receiving section that receives the liquid. The receiving section receives a liquid that leaks from the liquid container.

The mounting unit described in JP-A-2016-88016 is further provided with a detecting portion that detects the liquid received by the receiving section. In this mounting unit, the detecting portion detects the liquid, whereby it is detected that the liquid is leaking from the liquid container, that is, the liquid leakage is detected.

In such a mounting unit, when the liquid container is mounted or dismounted, there is a case where a small amount of liquid drips from the liquid container, that is, liquid dripping occurs with mounting or dismounting. In this case, when the liquid falls to the receiving section, there is a case where the detecting portion detects the liquid. That is, in the case of the mounting unit described in JP-A-2016-88016, there is a concern that it may not be possible to distinguish between the liquid leakage and the liquid dripping.

SUMMARY

According to an aspect of the present disclosure, there is provided a mounting unit including a mounting portion to which a liquid container that accommodates a liquid is mounted, in which the mounting portion has a liquid introduction portion that is inserted into the liquid container that is mounted to the mounting portion, and a first receiving portion that is provided below the liquid introduction portion, the first receiving portion has a first recess portion and a second recess portion, the liquid introduction portion extends in a direction opposite to a mounting direction that is a direction in which the liquid container moves when the liquid container is mounted to the mounting portion, and the second recess portion is provided at a position closer to a tip of the liquid introduction portion than the first recess portion is in the mounting direction.

According to another aspect of the present disclosure, there is provided a liquid ejection apparatus including the mounting unit described above, and a liquid ejection head that ejects a liquid accommodated in the liquid container mounted to the mounting portion.

DESCRIPTION OF EXEMPLARY EMBODIMENTS

1. Embodiment 1

Hereinafter, Embodiment 1 of a liquid ejection apparatus provided with a mounting unit will be described with reference to the drawings. The liquid ejection apparatus is, for example, an ink jet printer that records an image such as a character or a photograph by ejecting ink, which is an example of a liquid, onto a medium such as paper.

Figure 1:
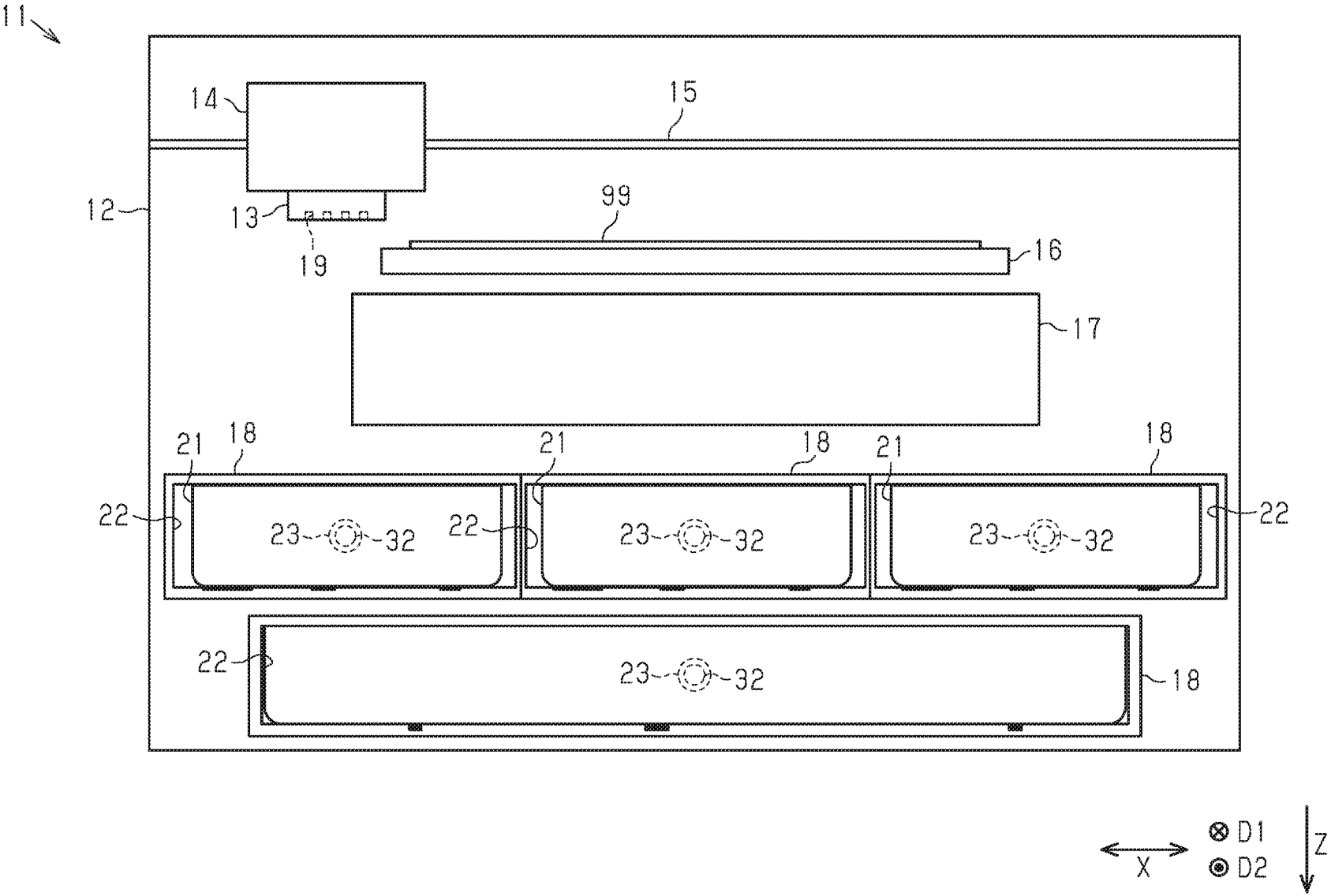
FIG. 1 is a front view showing an embodiment of a liquid ejection apparatus provided with a mounting unit.

As shown in FIG. 1, a liquid ejection apparatus 11 includes a casing 12, a liquid ejection head 13, a carriage 14, and a guide shaft 15. The liquid ejection apparatus 11 includes a support section 16 and an accommodation section 17. The liquid ejection apparatus 11 includes a mounting unit 18.

The casing 12 accommodates various configurations of the liquid ejection apparatus 11. The shape of the casing 12 is, for example, a rectangular parallelepiped or a rectangular parallelepiped shape.

The liquid ejection head 13 is configured to eject a liquid. The liquid ejection head 13 has a nozzle 19. The liquid ejection head 13 ejects the liquid onto a medium 99 through the nozzle 19. In this way, an image is printed on the medium 99.

The carriage 14 is mounted with the liquid ejection head 13. The carriage 14 is supported on the guide shaft 15. The carriage 14 moves along the guide shaft 15. The carriage 14 scans the medium 99 by reciprocating along the guide shaft 15. That is, the liquid ejection apparatus 11 of this embodiment is a serial type printer. The liquid ejection apparatus 11 may be a line type printer capable of ejecting a liquid all at once across the width of the medium 99.

The guide shaft 15 is installed, for example, inside the casing 12. The guide shaft 15 extends in one direction. A scanning direction X in which the carriage 14 performs scanning is the direction in which the guide shaft 15 extends. The scanning direction X indicates both the direction from one end toward the other end of the guide shaft 15 and the direction from the other end toward one end of the guide shaft 15.

The support section 16 is configured with, for example, a plate-shaped member extending in the scanning direction X. The support section 16 supports the medium 99. The support section 16 of this embodiment supports the medium 99 from below. The support section 16 is located below the liquid ejection head 13. The support section 16 faces the liquid ejection head 13.

The accommodation section 17 is configured to accommodate the medium 99. The accommodation section 17 can accommodate a plurality of media 99 in a state where the plurality of media 99 are stacked. The medium 99 accommodated in the accommodation section 17 is transported toward the support section 16 by, for example, a roller (not shown) provided in the liquid ejection apparatus 11. That is, the accommodation section 17 accommodates the medium 99 before printing.

One or a plurality of mounting units 18 are provided. In this embodiment, four mounting units 18 are provided. The four mounting unit 18 are provided to be divided into two upper and lower stages. Three mounting units 18 among the four mounting units 18 are provided in the upper stage, and one mounting unit 18 is provided in the lower stage. The three mounting units 18 provided in the upper stage are arranged in the scanning direction X.

The mounting unit 18 is configured such that a liquid container 21 that accommodates a liquid can be mounted therein. In the mounting unit 18, for example, one or a plurality of liquid accommodation bodies 21 can be mounted. In the mounting unit 18 of this embodiment, one liquid container 21 can be mounted. In this embodiment, in one mounting unit 18 provided in the lower stage, the liquid container 21 having capacity larger than those in the three mounting units 18 provided in the upper stage can be mounted.

The mounting unit 18 has a mounting port 22. The mounting port 22 is an opening through which the liquid container 21 passes when the liquid container 21 is mounted in the mounting unit 18. The mounting port 22 is open in the casing 12, for example.

The shape of the liquid container 21 is, for example, a rectangular parallelepiped or a rectangular parallelepiped shape. The plurality of liquid accommodation bodies 21 respectively accommodate, for example, different types of liquids. In this embodiment, the plurality of liquid accommodation bodies 21 accommodate ink of different colors. For example, the large capacity liquid container 21 which is mounted in the mounting unit 18 in the lower stage accommodates black ink that is frequently consumed.

The liquid container 21 can be mounted in and dismounted from the mounting unit 18. In this embodiment, the liquid container 21 is mounted in the mounting unit 18 by being pushed in the mounting unit 18 through the mounting port 22. The liquid container 21 is removed from the mounting unit 18 by being pulled out from the mounting unit 18 through the mounting port 22.

In this embodiment, the direction in which the liquid container 21 moves when the liquid container 21 is mounted in the mounting unit 18 is a mounting direction D1. Conversely, the direction in which the liquid container 21 moves when the liquid container 21 is removed from the mounting unit 18 is a removal direction D2. The removal direction D2 is the direction opposite to the mounting direction D1. In this embodiment, the mounting direction D1 and the removal direction D2 are directions different from the scanning direction X and a vertical direction Z.

The liquid container 21 has a supply port 23. When the liquid container 21 is mounted in the mounting unit 18, the liquid accommodated in the liquid container 21 can be supplied to the liquid ejection head 13 through the supply port 23. That is, the liquid container 21 accommodates the liquid to be supplied to the liquid ejection head 13. In other words, the liquid ejection head 13 ejects the liquid accommodated in the liquid container 21 mounted in the mounting unit 18.

Next, the mounting unit 18 will be described in detail.

Figure 2:
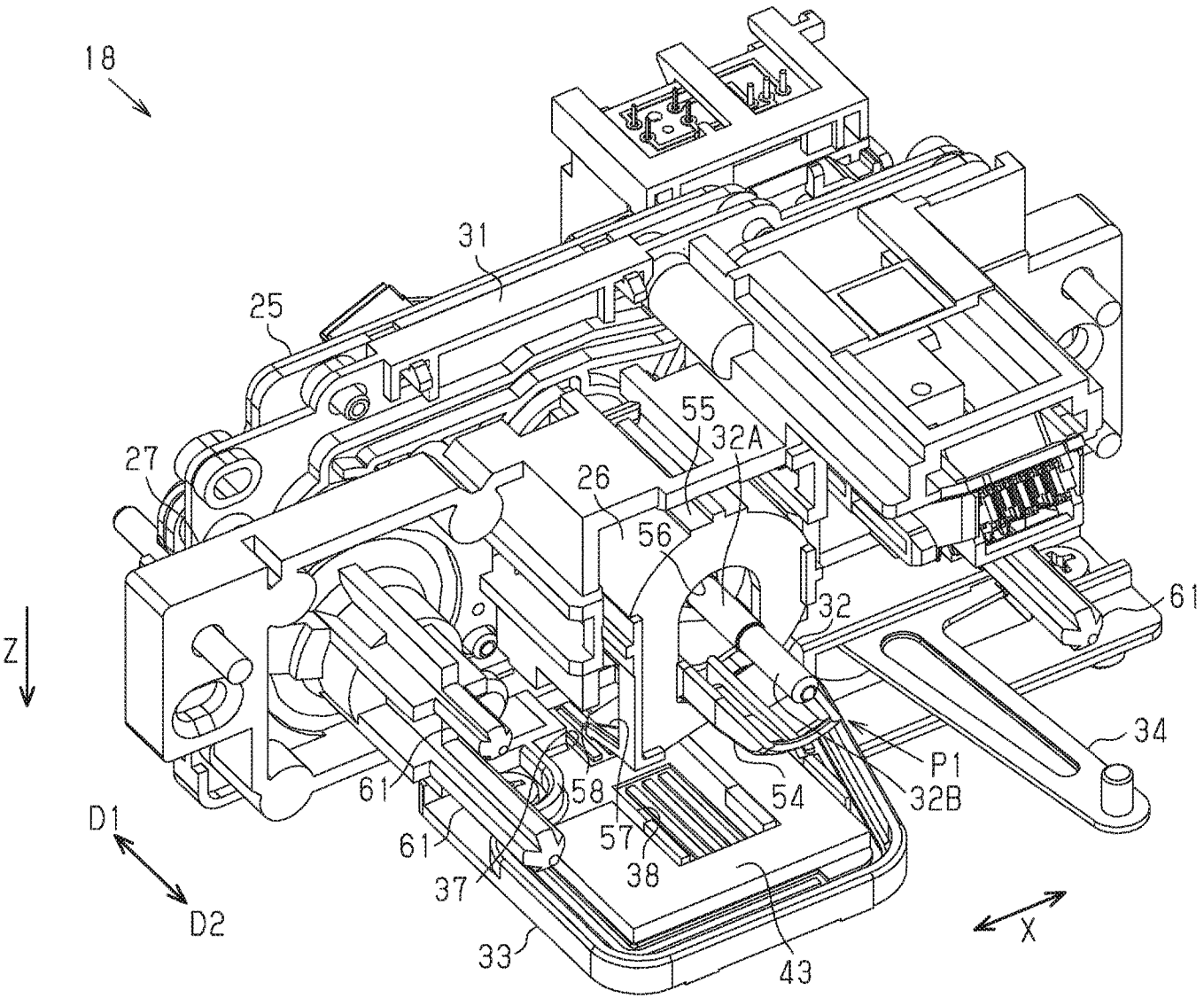
FIG. 2 is a perspective view of the mounting unit when a slider is located at a first position.
Figure 3:
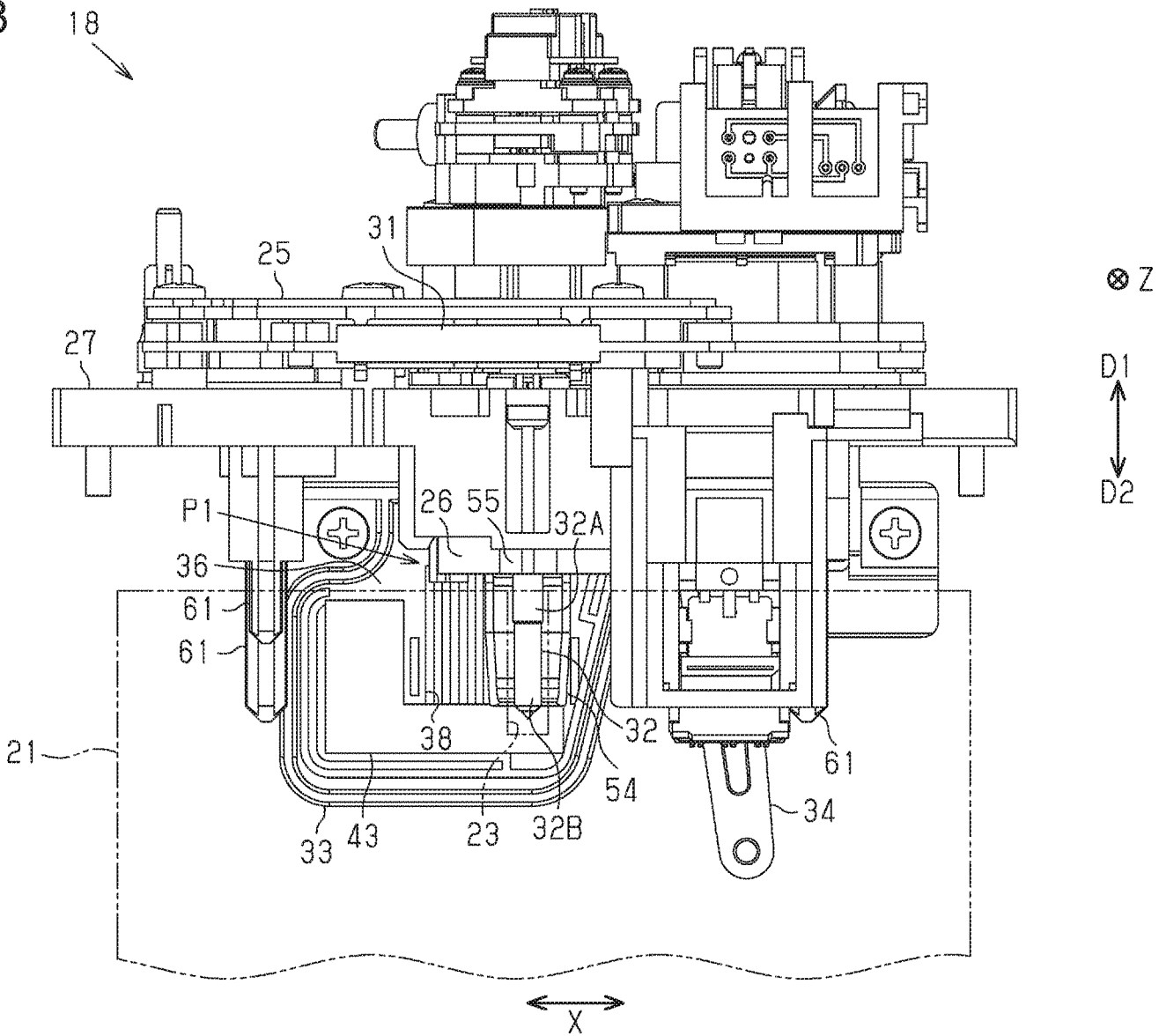
FIG. 3 is a top view of the mounting unit when the slider is located at the first position.

As shown in FIGS. 2 and 3, the mounting unit 18 includes a mounting portion 25 and a slider 26. The mounting unit 18 of this embodiment further includes a holder 27.

The mounting portion 25 is configured such that the liquid container 21 is mounted thereto. The mounting portion 25 has a base member 31, a liquid introduction portion 32, and a first receiving portion 33. The mounting portion 25 of this embodiment further has a lock lever 34.

The base member 31 is a member that serves as a base of the mounting unit 18. When the liquid container 21 is mounted to the mounting portion 25, the base member 31 faces the surface of the liquid container 21, on which the supply port 23 is provided. That is, when the liquid container 21 is mounted to the mounting portion 25, the liquid container 21 and the base member 31 are located in this order in the mounting direction D1.

One or a plurality of liquid introduction portions 32 are provided. In this embodiment, one liquid introduction portion 32 is provided. The liquid introduction portion 32 is, for example, a needle for introducing the liquid from the liquid container 21 into the mounting unit 18. The liquid introduction portion 32 of this embodiment is configured in a cylindrical shape, for example. The liquid introduction portion 32 extends from the base member 31. The liquid introduction portion 32 extends in the removal direction D2.

The liquid introduction portion 32 is inserted into the liquid container 21 which is mounted to the mounting portion 25. Specifically, the liquid introduction portion 32 is inserted into the supply port 23 of the liquid container 21 which is mounted to the mounting portion 25. When the liquid introduction portion 32 is inserted into the supply port 23, the liquid accommodated in the liquid container 21 can be supplied to the liquid ejection head 13 through the mounting unit 18.

The liquid introduction portion 32 has a base end portion 32A and a tip portion 32B. The tip portion 32B is a portion that is inserted into the supply port 23 when the liquid container 21 is mounted to the mounting portion 25. The base end portion 32A and the tip portion 32B are located in this order in the removal direction D2. The tip portion 32B extends in the removal direction D2 from the base end portion 32A.

Figure 4:
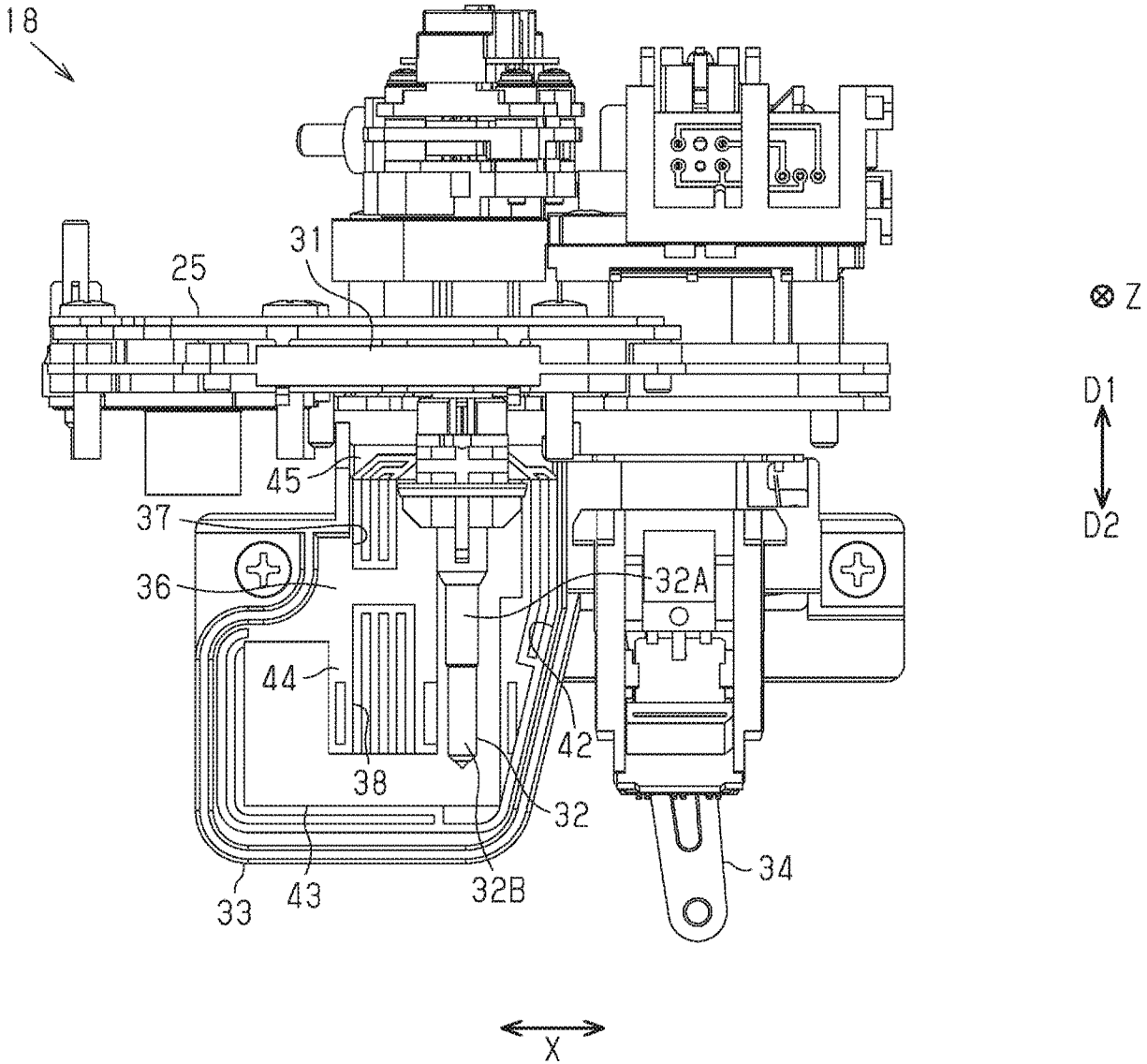
FIG. 4 is a top view in which the slider and a holder are omitted from the mounting unit shown in FIG. 3.

As shown in FIG. 4, the first receiving portion 33 is provided below the liquid introduction portion 32. When the mounting unit 18 is viewed from above, the first receiving portion 33 overlaps the liquid introduction portion 32. That is, the first receiving portion 33 vertically overlaps the liquid introduction portion 32.

The first receiving portion 33 is, for example, a tray. The first receiving portion 33 receives the liquid falling from above the first receiving portion 33. The first receiving portion 33 receives, for example, the liquid falling from the liquid container 21 and the liquid falling from the liquid introduction portion 32.

When the liquid container 21 is removed from the mounting portion 25, there is a case where the liquid falls from the tip portion 32B of the liquid introduction portion 32. When the liquid container 21 is removed from the mounting portion 25, the liquid container 21 moves to the position where it is pulled out with respect to the tip portion 32B of the liquid introduction portion 32, as compared with a case where the liquid container 21 is mounted to the mounting portion 25. In other words, when the liquid container 21 is removed from the mounting portion 25, the liquid container 21 moves to a position displaced in the removal direction D2 from the tip portion 32B of the liquid introduction portion 32, as compared with when the liquid container 21 is mounted to the mounting portion 25. That is, when the liquid container 21 is removed from the mounting portion 25, the supply port 23 moves to the position displaced in the removal direction D2 from the tip portion 32B of the liquid introduction portion 32, as compared with when the liquid container 21 is mounted to the mounting portion 25. At this time, since the tip portion 32B of the liquid introduction portion 32 is exposed, there is a case where the liquid falls from there. The liquid that falls from the tip portion 32B of the liquid introduction portion 32 falls toward the position closer to the tip of the liquid introduction portion 32 with respect to the first receiving portion 33 in the mounting direction D1.

When the liquid container 21 is removed from the mounting portion 25, the amount of liquid that falls from the tip portion 32B of the liquid introduction portion 32 is very small. At this time, a small amount of fallen liquid drips to the first receiving portion 33. Therefore, in the present specification, the liquid falling from the tip portion 32B of the liquid introduction portion 32 at the time of mounting or dismounting of the liquid container 21, that is, in a state where the liquid container 21 is not mounted to the mounting portion 25, is called liquid dripping.

When the liquid container 21 is mounted to the mounting portion 25, if the liquid container 21 is obliquely pushed in with respect to the mounting portion 25, the liquid container 21 is not sufficiently pushed in the mounting portion 25, or foreign matter is caught between the liquid introduction portion 32 and the supply port 23, there is a case where the liquid introduction portion 32 is not properly inserted into the supply port 23. In this case, there is a case where the liquid leaks from the liquid container 21. The liquid leaking from the liquid container 21 falls from the supply port 23 or the liquid introduction portion 32. That is, the liquid that leaks from the liquid container 21 falls from the supply port 23, or travels through the liquid introduction portion 32 and then falls from the supply port 23.

When the liquid container 21 is mounted to the mounting portion 25, the liquid container 21 is located at the position where it is pushed in with respect to the tip portion 32B of the liquid introduction portion 32, as compared with when the liquid container 21 is removed from the mounting portion 25. In other words, when the liquid container 21 is mounted to the mounting portion 25, the liquid container 21 is located at the position displaced in the mounting direction D1, as compared with when the liquid container 21 is removed from the mounting portion 25. That is, when the liquid container 21 is mounted to the mounting portion 25, the supply port 23 is located at the position displaced in the mounting direction D1, as compared with when the liquid container 21 is removed from the mounting portion 25. Therefore, when the liquid container 21 is mounted to the mounting portion 25, the liquid leaking from the liquid container 21 travels through the liquid introduction portion 32 from the supply port 23 to fall from the base end portion 32A of the liquid introduction portion 32. In summary, when the liquid container 21 is mounted to the mounting portion 25, the liquid leaking from the liquid container 21 falls from the supply port 23 or the base end portion 32A of the liquid introduction portion 32. As a result, the liquid leaking from the liquid container 21 when the liquid container 21 is mounted to the mounting portion 25 falls toward the position closer to the base end of the liquid introduction portion 32 with respect to the first receiving portion 33 in the mounting direction D1.

When the liquid introduction portion 32 is not properly inserted into the supply port 23, the liquid continues to leak from the liquid container 21. Therefore, when the liquid container 21 is mounted to the mounting portion 25, the amount of liquid leaking due to improper insertion of the liquid introduction portion 32 into the supply port 23 is larger than that in the case of the liquid dripping. At this time, a large amount of leaked liquid falls toward the first receiving portion 33. Therefore, in the present specification, the falling of the liquid from the liquid container 21 in a state where the liquid container 21 is mounted to the mounting portion 25 is called liquid leakage.

As described above, the position of the supply port 23 changes according to whether the liquid container 21 is removed from the mounting portion 25 or the liquid container 21 is mounted to the mounting portion 25. The position of the supply port 23 changes, whereby the position where the liquid leaking from the liquid container 21 falls changes. That is, the liquid falling position differs according to whether the liquid container 21 is removed from the mounting portion 25 or the liquid container 21 is mounted to the mounting portion 25.

Figure 5:
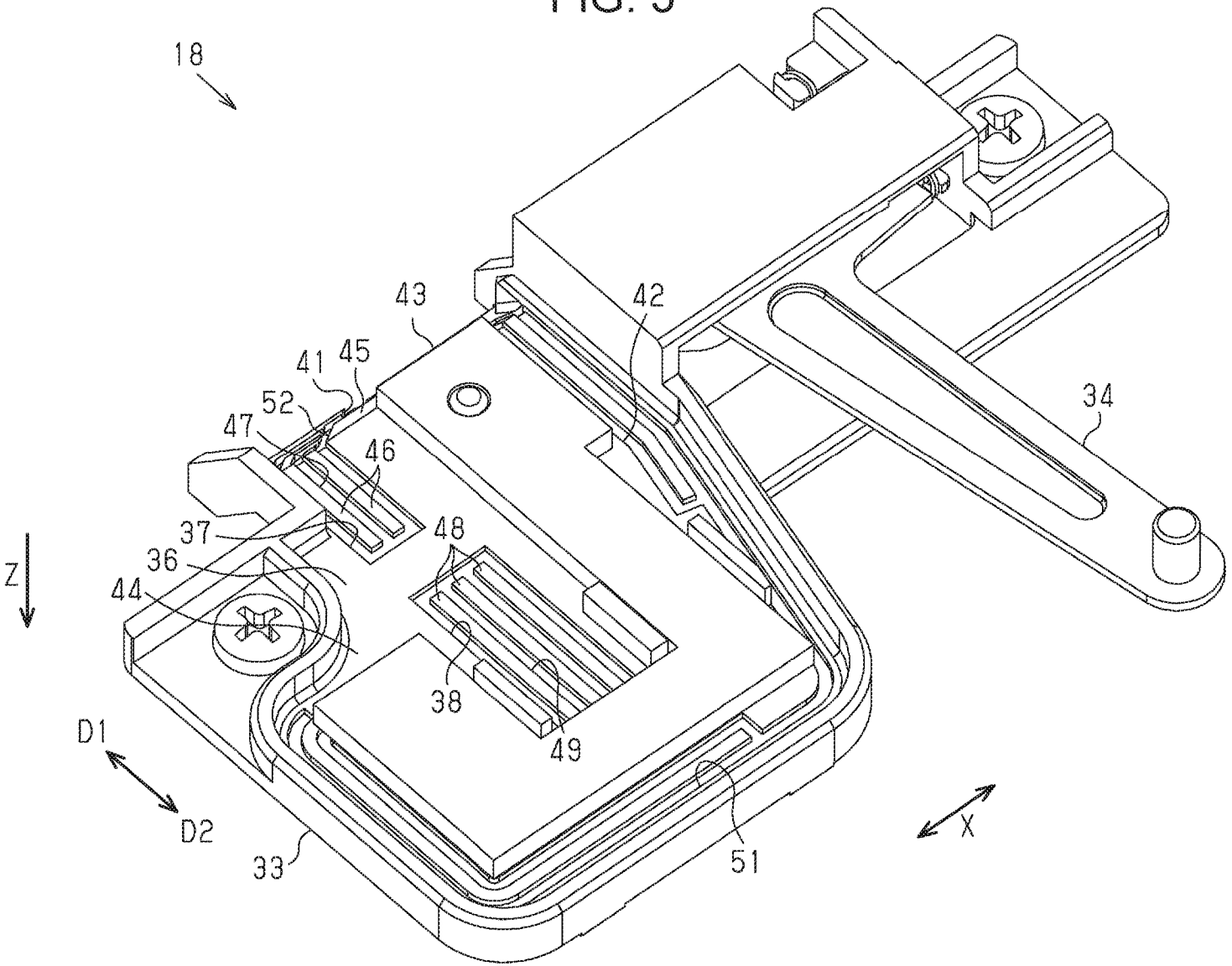
FIG. 5 is a perspective view of a first receiving portion.
Figure 6:
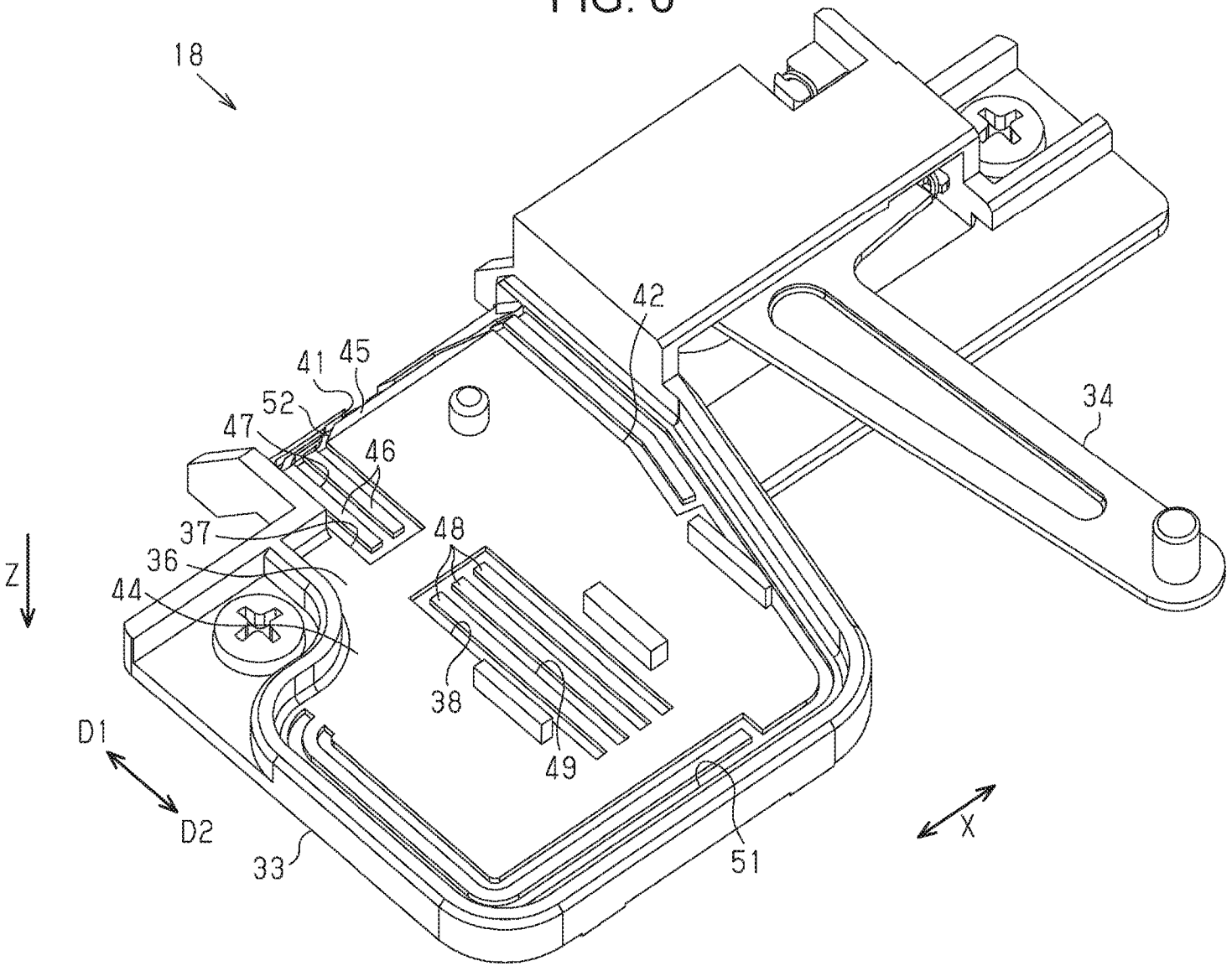
FIG. 6 is a perspective view in which an absorber is omitted from the first receiving portion shown in FIG. 5.
Figure 7:
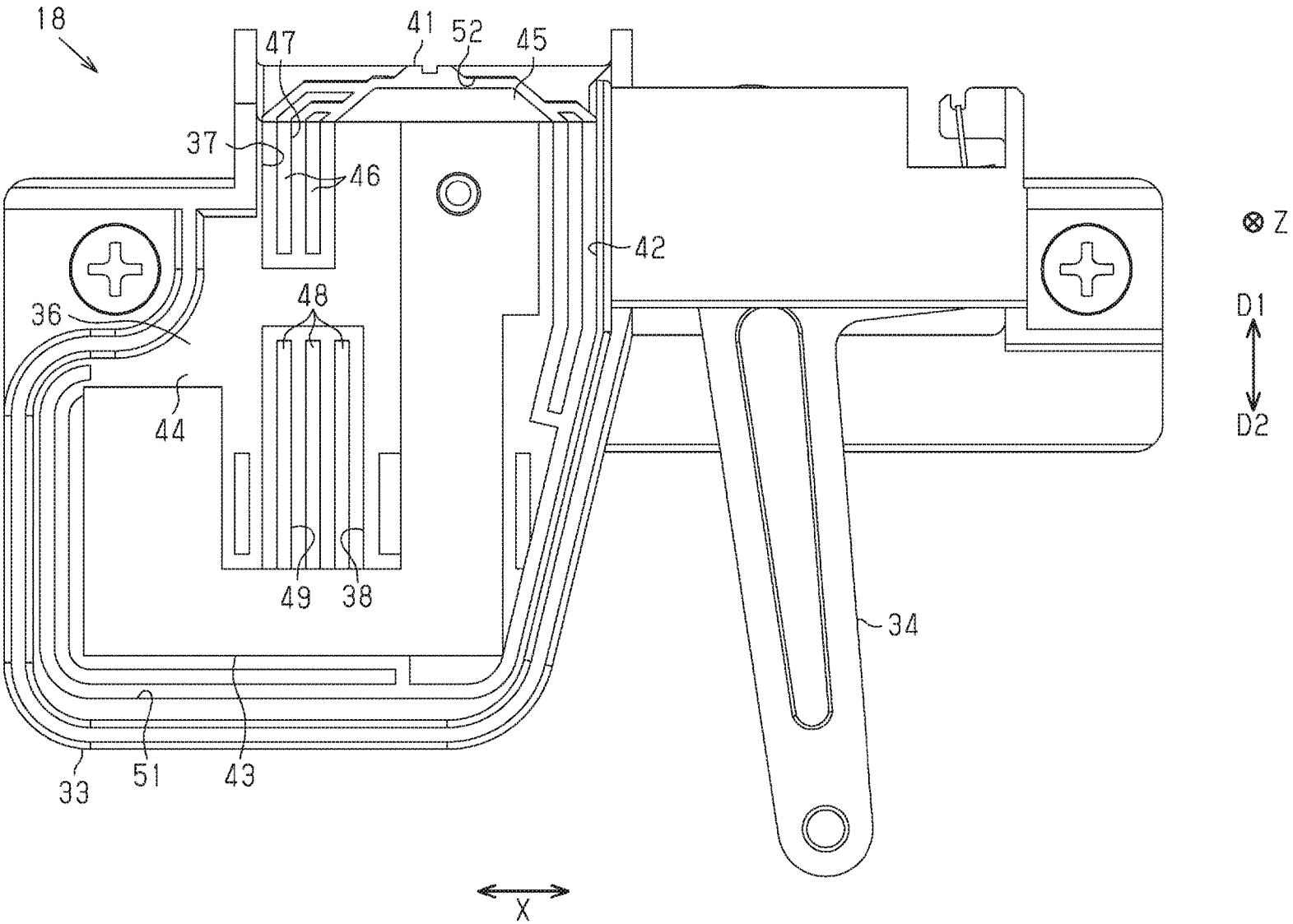
FIG. 7 is a top view of the first receiving portion.

As shown in FIGS. 5, 6, and 7, the first receiving portion 33 has a receiving surface 36, a first recess portion 37, and a second recess portion 38. The first receiving portion 33 of this embodiment further has a discharge port 41, an outer peripheral groove 42, and an absorber 43.

The receiving surface 36 is a surface facing upward. The receiving surface 36 has a first surface 44 and a second surface 45. The first surface 44 and the second surface 45 are located in this order in the mounting direction D1. That is, the first surface 44 is located at the position displaced in the removal direction D2 from the second surface 45.

The first surface 44 is continuous with the second surface 45. In this embodiment, the area of the first surface 44 is larger than the area of the second surface 45. The first surface 44 of this embodiment is a horizontal surface.

The second surface 45 is a surface that is continuous with the first surface 44 and the discharge port 41. The second surface 45 is inclined downward from the first surface 44 toward the discharge port 41. That is, the second surface 45 is inclined downward in the mounting direction D1.

The first recess portion 37 is provided on the first surface 44. The first recess portion 37 is recessed downward. The first recess portion 37 is provided so as to extend in the removal direction D2 from the position that is the boundary between the first surface 44 and the second surface 45. As shown in FIG. 4, the first recess portion 37 of this embodiment is displaced from the liquid introduction portion 32 in the scanning direction X when the mounting unit 18 is viewed from above. That is, the first recess portion 37 of this embodiment does not vertically overlap the liquid introduction portion 32.

The first recess portion 37 receives the liquid due to the liquid leakage. This point will be described in detail later.

As shown in FIGS. 5, 6, and 7, one or a plurality of first ribs 46 are provided in the first recess portion 37 of this embodiment. In this embodiment, two first ribs 46 are provided. The first rib 46 extends in the removal direction D2 from the position that is the boundary between the first surface 44 and the second surface 45.

One or a plurality of first grooves 47 are formed in the first recess portion 37 due to the first rib 46. In this embodiment, three first grooves 47 are formed due to two first ribs 46. In this manner, the first recess portion 37 has a groove.

The first groove 47 extends in the removal direction D2 from the position that is the boundary between the first surface 44 and the second surface 45. Due to the first groove 47, the liquid received by the first recess portion 37 flows along the first groove 47. In this way, the liquid received by the first recess portion 37 is guided to the second surface 45.

The second recess portion 38 is provided on the first surface 44. The second recess portion 38 is recessed downward. The second recess portion 38 is a recess portion different from the first recess portion 37. As shown in FIG. 4, the second recess portion 38 of this embodiment is displaced in the scanning direction X from the liquid introduction portion 32 when the mounting unit 18 is viewed from above. That is, the second recess portion 38 of this embodiment does not vertically overlap the liquid introduction portion 32.

The second recess portion 38 receives the liquid due to the liquid dripping. This point will be described in detail later.

As shown in FIGS. 5, 6, and 7, the second recess portion 38 is provided at a distance in the removal direction D2 from the first recess portion 37. That is, the first recess portion 37 and the second recess portion 38 are separated from each other. In this way, a concern that the liquid received by the second recess portion 38 may flow to the first recess portion 37 is reduced. Similarly, a concern that the liquid received by the first recess portion 37 may flows to the second recess portion 38 is reduced.

The second recess portion 38 is located on the side opposite to the second surface 45 with the first recess portion 37 interposed therebetween in the mounting direction D1. That is, the first recess portion 37 is located between the second recess portion 38 and the discharge port 41. In this way, for example, even when the mounting unit 18 is tilted such that the first receiving portion 33 is inclined downward in the removal direction D2, a concern that the liquid may flow from the discharge port 41 to the second recess portion 38 is reduced.

In the mounting direction D1, the distance between the second recess portion 38 and the second surface 45 is longer than the distance between the first recess portion 37 and the second surface 45. The first recess portion 37 and the second recess portion 38 are located in this order in the removal direction D2. The second recess portion 38 is located at the position displaced in the removal direction D2 from the first recess portion 37. That is, the second recess portion 38 is provided at the position closer to the tip of the liquid introduction portion 32 than the first recess portion 37 is in the mounting direction D1. Conversely, the first recess portion 37 is provided at the position closer to the base end of the liquid introduction portion 32 than the second recess portion 38 is in the mounting direction D1.

One or a plurality of second ribs 48 are provided in the second recess portion 38. In this embodiment, three second ribs 48 are provided. The second rib 48 extends in the removal direction D2.

One or a plurality of second grooves 49 are formed in the second recess portion 38 due to the second rib 48. In this embodiment, four second grooves 49 are formed due to the three second ribs 48. In this manner, the second recess portion 38 has a groove.

The second groove 49 extends in the removal direction D2. The liquid received by the second recess portion 38 flows along the second groove 49 due to the second groove 49.

The discharge port 41 is open at the edge of the first receiving portion 33. The discharge port 41 is an opening for discharging the liquid from the first receiving portion 33.

The outer peripheral groove 42 is provided on the receiving surface 36. The outer peripheral groove 42 extends along the edge of the receiving surface 36. The outer peripheral groove 42 extends along the outer periphery of the absorber 43. The outer peripheral groove 42 includes a first outer peripheral groove 51 and a second outer peripheral groove 52.

The first outer peripheral groove 51 is a portion provided on the first surface 44, of the outer peripheral groove 42. The first outer peripheral groove 51 extends along the edge of the first surface 44. One end of the first outer peripheral groove 51 is connected to one end of the second outer peripheral groove 52.

The second outer peripheral groove 52 is a portion provided on the second surface 45, of the outer peripheral groove 42. In the second outer peripheral groove 52, an end portion opposite to the end portion which is connected to the first outer peripheral groove 51 is connected to the first recess portion 37. In this embodiment, the second outer peripheral groove 52 is continuous with the first groove 47.

The second outer peripheral groove 52 is continuous with the discharge port 41 between the end portion which is continuous with the first outer peripheral groove 51 and the end portion which is continuous with the first recess portion 37. That is, the second outer peripheral groove 52 is continuous with the first outer peripheral groove 51, the discharge port 41, and the first recess portion 37. Therefore, the liquid received by the first recess portion 37 is guided to the discharge port 41 through the second outer peripheral groove 52. In this way, the discharge port 41 discharges the liquid received by the first recess portion 37 from the first receiving portion 33. Further, the liquid flowing through the first outer peripheral groove 51 is guided to the discharge port 41 through the second outer peripheral groove 52.

The absorber 43 is provided on the receiving surface 36. In this embodiment, the absorber 43 is provided on the first surface 44.

The absorber 43 is provided at the position in contact with the second recess portion 38. In this embodiment, the absorber 43 is provided at the position that vertically overlaps the end portion of the second recess portion 38. More specifically, the absorber 43 vertically overlaps the end portion of the second recess portion 38 on the side opposite to the end portion adjacent to the first recess portion 37. That is, the absorber 43 overlaps the end portion of the second recess portion 38 that is closer to the tip of the liquid introduction portion 32 in the mounting direction D1.

The absorber 43 of this embodiment is provided at the position that is in contact with the second rib 48. That is, the absorber 43 is provided at the position that is in contact with the second groove 49. In this way, the liquid received by the second recess portion 38 is guided to the second groove 49 to be absorbed by the absorber 43. The absorber 43 holds the liquid by absorbing the liquid. The absorber 43 is, for example, a foam such as urethane, or a non-woven fabric.

The absorber 43 of this embodiment vertically overlaps the end portion of the first outer peripheral groove 51 on the side opposite to the end portion which is connected to the second outer peripheral groove 52. Therefore, when the absorber 43 is saturated with the liquid, the liquid flows from the absorber 43 to the first outer peripheral groove 51. The liquid flowing through the first outer peripheral groove 51 is discharged from the discharge port 41 through the second outer peripheral groove 52.

The lock lever 34 is mounted to the first receiving portion 33. The lock lever 34 extends in the removal direction D2. The lock lever 34 locks the liquid container 21 in a state where the liquid container 21 is mounted to the mounting portion 25. In this embodiment, when the liquid container 21 mounted to the mounting portion 25 is pushed in the mounting direction D1, the locking by the lock lever 34 is released. In this way, it becomes possible to pull out the liquid container 21 in the removal direction D2.

Figure 8:
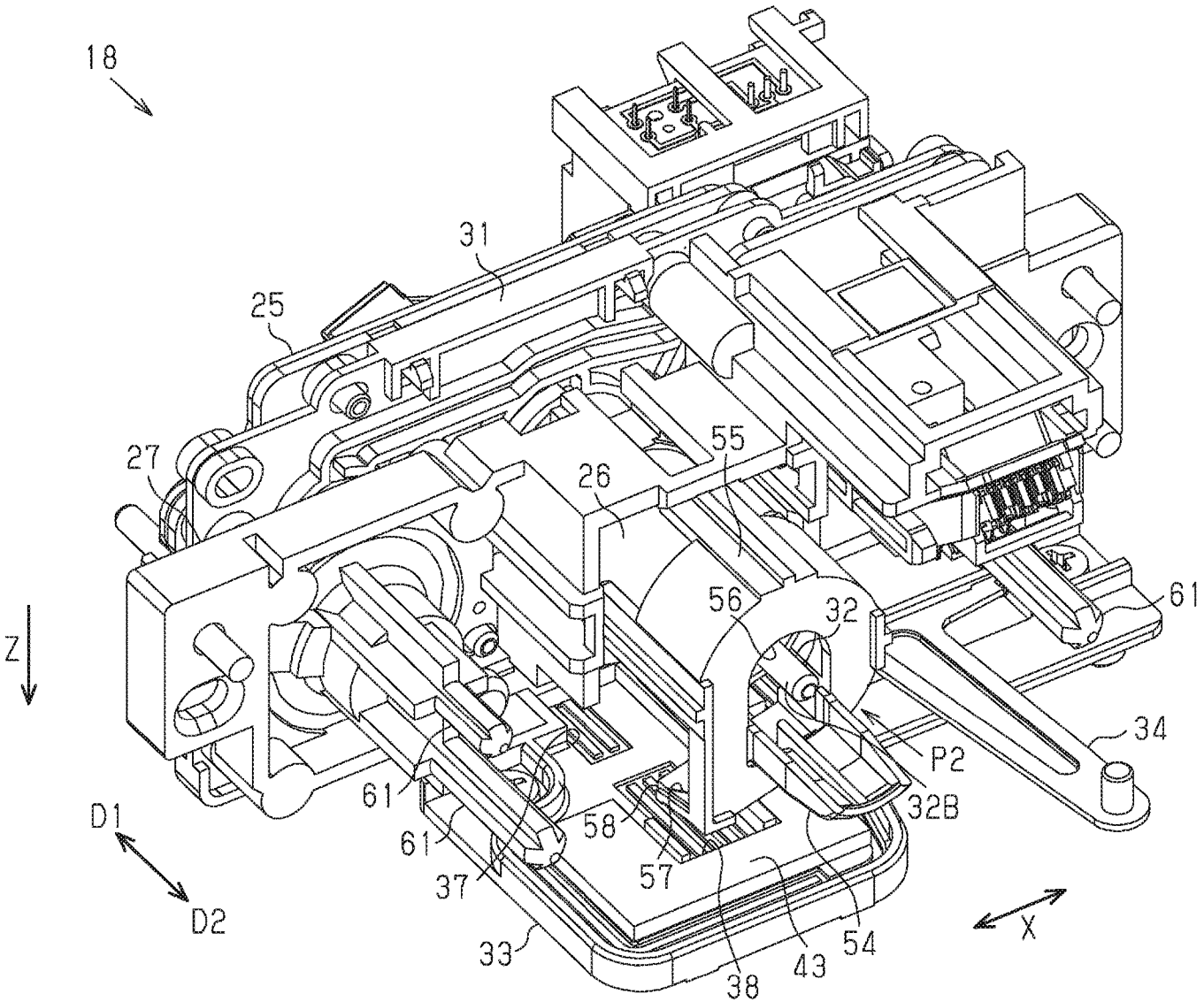
FIG. 8 is a perspective view of the mounting unit when the slider is located at a second position.

As shown in FIGS. 2 and 8, the slider 26 is held by the holder 27. The slider 26 is located above the first receiving portion 33. The slider 26 is configured to be movable in the mounting direction D1 and the removal direction D2 with respect to the mounting portion 25. Therefore, the slider 26 moves with respect to the liquid introduction portion 32.

The slider 26 is configured to move between a first position P1 and a second position P2. When the slider 26 is displaced from the first position P1 to the second position P2, the slider 26 moves in the removal direction D2. When the slider 26 is displaced from the second position P2 to the first position P1, the slider 26 moves in the mounting direction D1. Therefore, the slider 26 which is located at the first position P1 is located at the position closer to the base end of the liquid introduction portion 32 than the slider 26 which is located at the second position P2 is in the mounting direction D1. Conversely, the slider 26 which is located at the second position P2 is located at the position closer to the tip of the liquid introduction portion 32 than the slider 26 which is located at the first position P1 is in the mounting direction D1. The slider 26 shown in FIG. 2 is located at the first position P1. The slider 26 shown in FIG. 8 is located at the second position P2.

The slider 26 is pressed by, for example, a spring (not shown) so as to be located at the second position P2. That is, the slider 26 is pressed in the removal direction D2.

The slider 26 is displaced to the first position P1 by being pushed in the mounting direction D1 by the liquid container 21 which is mounted to the mounting portion 25. Therefore, when the liquid container 21 is mounted to the mounting portion 25, the slider 26 is located at the first position P1.

If the liquid container 21 is removed from the mounting portion 25, the slider 26 is displaced to the second position P2 by moving in the removal direction D2 by the force of a spring (not shown). Therefore, the slider 26 is located at the second position P2 when the liquid container 21 is not mounted to the mounting portion 25.

The slider 26 has a receiver 54 and a cover body 55.

Figure 9:
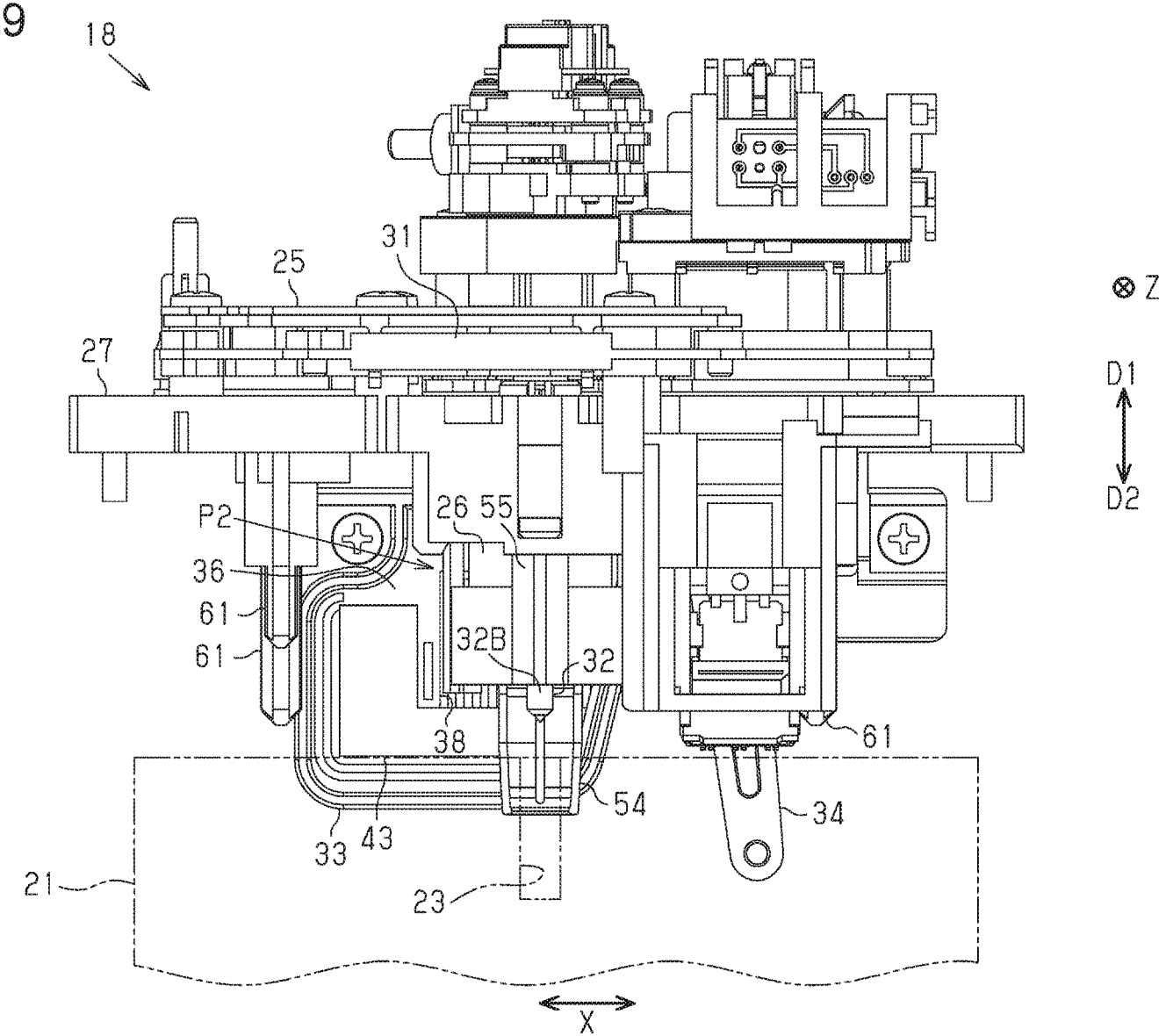
FIG. 9 is a top view of the mounting unit when the slider is located at the second position.

As shown in FIGS. 3 and 9, the receiver 54 extends in the removal direction D2 from the cover body 55. The receiver 54 is provided below the liquid introduction portion 32. The receiver 54 vertically overlaps the liquid introduction portion 32. That is, the receiver 54 is located immediately below the liquid introduction portion 32. The receiver 54 is provided between the liquid introduction portion 32 and the first receiving portion 33 in the vertical direction Z. Therefore, if the liquid leakage or the liquid dripping occurs, the receiver 54 receives the liquid.

When the slider 26 is located at the first position P1, the tip of the liquid introduction portion 32 protrudes from the tip of the receiver 54 when the mounting unit 18 is viewed from above. When the slider 26 is located at the second position P2, the tip of the liquid introduction portion 32 does not protrude from the tip of the receiver 54 when the mounting unit 18 is viewed from above.

The receiver 54 is inclined downward in the mounting direction D1. Therefore, the liquid received by the receiver 54 flows in the mounting direction D1. As a result, the liquid received by the receiver 54 flows to the cover body 55.

As shown in FIGS. 2 and 8, the cover body 55 is configured to cover the liquid introduction portion 32. The cover body 55 of this embodiment is configured in a tubular shape, for example. The cover body 55 has an exposure hole 56 that exposes a part of the liquid introduction portion 32.

When the slider 26 is located at the first position P1, the base end portion 32A and the tip portion 32B are exposed from the exposure hole 56. When the slider 26 is located at the second position P2, the tip portion 32B is exposed from the exposure hole 56. In this embodiment, the receiver 54 extends in the removal direction D2 from the lower edge of the exposure hole 56. Therefore, the liquid received by the receiver 54 passes through the exposure hole 56.

The cover body 55 has a guideway 57 and a discharge portion 58.

The guideway 57 is located above the first receiving portion 33. The guideway 57 vertically overlaps the first receiving portion 33.

The guideway 57 is continuous with the receiver 54 and the discharge portion 58. The guideway 57 extends while being inclined downward from the receiver 54 toward the discharge portion 58. In this way, the guideway 57 guides the liquid received by the receiver 54 to the discharge portion 58.

The discharge portion 58 is located above the first receiving portion 33. The discharge portion 58 is located below the receiver 54. The discharge portion 58 vertically overlaps the first receiving portion 33.

The discharge portion 58 discharges the liquid guided by the guideway 57 to the first receiving portion 33. Specifically, the liquid guided by the guideway 57 travels through the discharge portion 58 and falls to the first receiving portion 33. At this time, the liquid falls directly below the discharge portion 58. When the distance between the discharge portion 58 and the first receiving portion 33 in the vertical direction Z is short, the liquid flows from the discharge portion 58 along the first receiving portion 33. In this manner, the discharge portion 58 discharges the liquid received by the receiver 54 to the first receiving portion 33.

Figure 10:
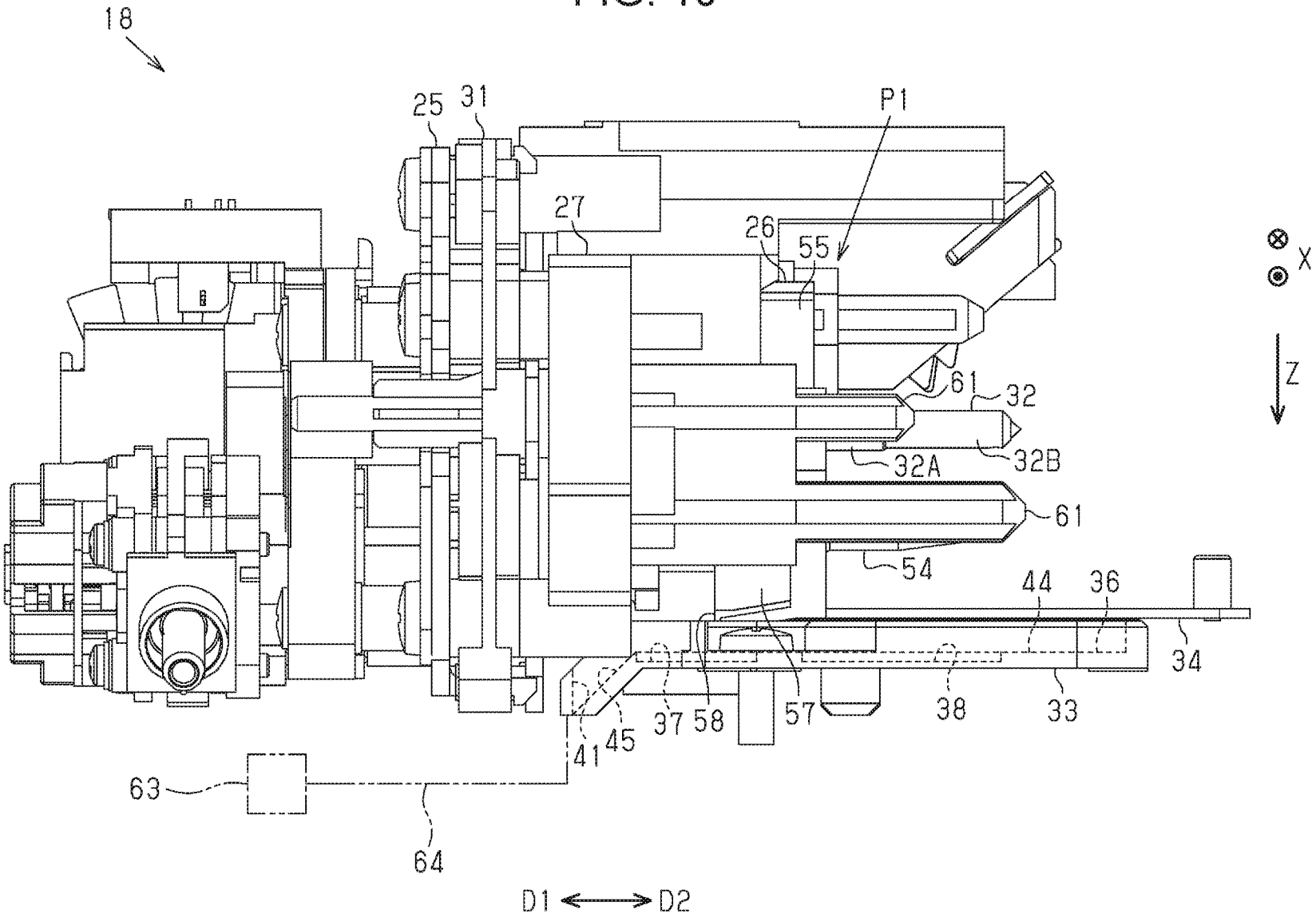
FIG. 10 is a side view of the mounting unit when the slider is located at the first position.

As shown in FIG. 10, when the mounting unit 18 is located at the first position P1, the discharge portion 58 is located immediately above the first recess portion 37. That is, when the mounting unit 18 is located at the first position P1, the discharge portion 58 vertically overlaps the first recess portion 37. Therefore, when the mounting unit 18 is located at the first position P1, the liquid received by the receiver 54 is discharged to the first recess portion 37. In this manner, the first recess portion 37 receives the liquid due to the liquid leakage.

Figure 11:
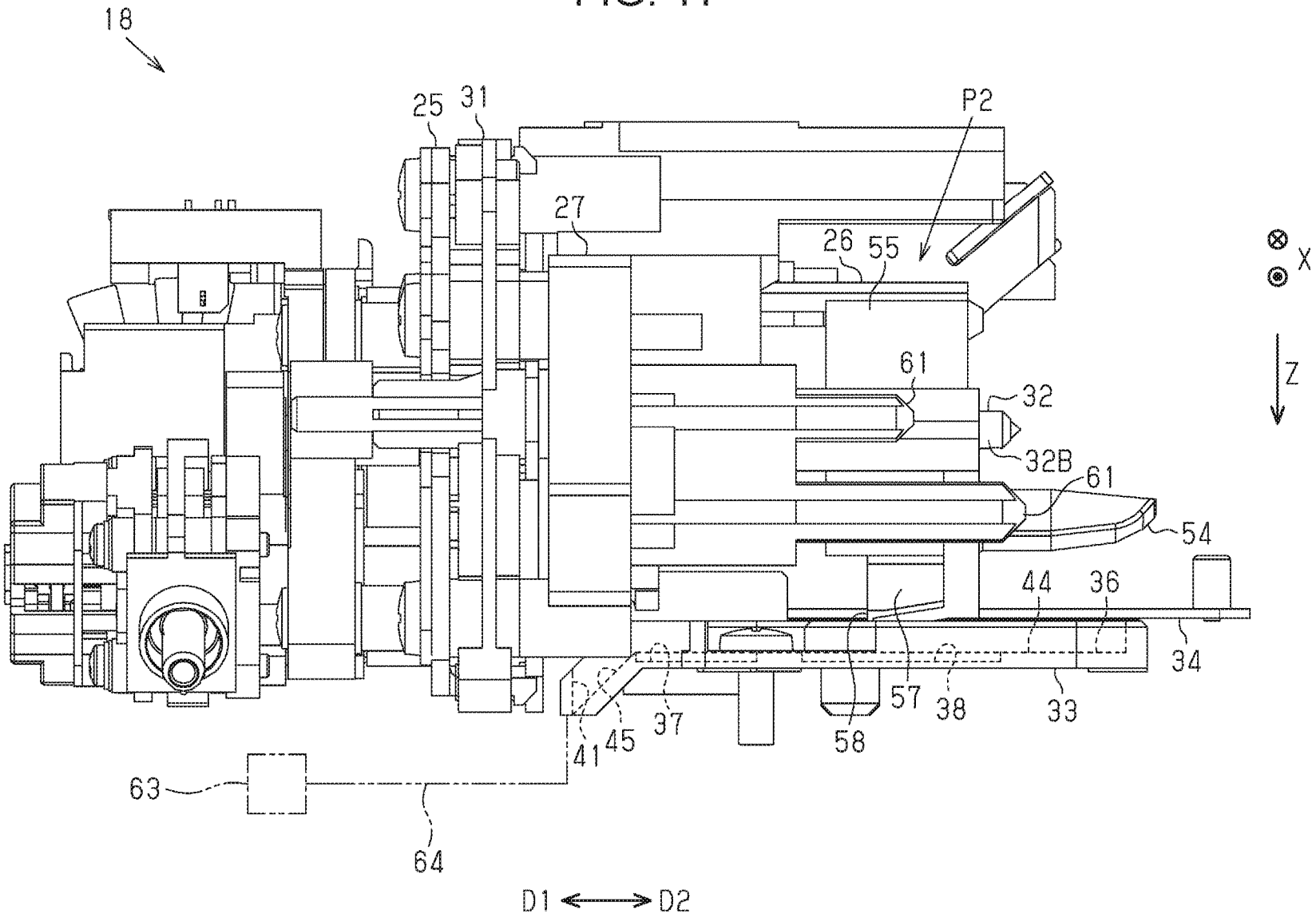
FIG. 11 is a side view of the mounting unit when the slider is located at the second position.

As shown in FIG. 11, when the mounting unit 18 is located at the second position P2, the discharge portion 58 is located immediately above the second recess portion 38. That is, when the mounting unit 18 is located at the second position P2, the discharge portion 58 vertically overlaps the second recess portion 38. Therefore, when the mounting unit 18 is located at the second position P2, the liquid received by the receiver 54 is discharged to the second recess portion 38. In this manner, the second recess portion 38 receives the liquid due to the liquid dripping.

The holder 27 is mounted to the mounting portion 25. The holder 27 has one or a plurality of guide pins 61. In this embodiment, the holder 27 has three guide pins 61. The guide pin 61 is inserted into a hole provided in the liquid container 21 to guide the movement of the liquid container 21 when the liquid container 21 is mounted to or dismounted from the mounting portion 25.

As shown in FIGS. 10 and 11, the mounting unit 18 of this embodiment may include a detecting portion 63 and a guide path 64.

The detecting portion 63 is, for example, a sensor that detects the liquid. For example, when the detecting portion 63 detects the liquid, the detecting portion 63 transmits a signal to a CPU with which the liquid ejection apparatus 11 is provided.

The guide path 64 is connected to the discharge port 41 and the detecting portion 63. The guide path 64 is a flow path through which the liquid discharged from the discharge port 41 flows. The guide path 64 extends, for example, while being inclined downward from the discharge port 41 toward the detecting portion 63. In this way, the guide path 64 guides the liquid discharged from the discharge port 41 to the detecting portion 63. The liquid ejection apparatus 11 can detect the liquid leakage of the liquid container 21 by detecting the liquid by the detecting portion 63.

Next, the operation and effect of the above embodiment will be described.

1. When the liquid container 21 is mounted to the mounting portion 25, the slider 26 is located at the first position P1 where the discharge portion 58 vertically overlaps the first recess portion 37. When the liquid container 21 is not mounted to the mounting portion 25, the slider 26 is located at the second position P2 where the discharge portion 58 vertically overlaps the second recess portion 38. According to this, when the liquid container 21 is mounted to the mounting portion 25, the discharge portion 58 and the first recess portion 37 vertically overlap each other, and therefore, the liquid due to the liquid leakage is discharged to the first recess portion 37. When the liquid container 21 is not mounted to the mounting portion 25, the discharge portion 58 and the second recess portion 38 vertically overlap each other, and therefore, the liquid due to the liquid dripping is discharged to the second recess portion 38. Therefore, in the first receiving portion 33, a portion that receives the liquid due to the liquid leakage and a portion that receives the liquid due to the liquid dripping can be separated. Therefore, by confirming whether the first recess portion 37 receives the liquid or the second recess portion 38 receives the liquid, it is possible to distinguish between the liquid leakage and the liquid dripping.

2. The first recess portion 37 has the first groove 47. The second recess portion 38 has the second groove 49. Each of the first recess portion 37 and the second recess portion 38 has a groove, whereby the liquid received by the first receiving portion 33 can be guided by the groove.

3. The first receiving portion 33 has the discharge port 41 for discharging the liquid received by the first recess portion 37 from the first receiving portion 33. It is estimated that the amount of liquid that is received by the first recess portion 37 when the liquid leakage occurs is larger than the amount of liquid that is received by the second recess portion 38 when the liquid dripping occurs. Therefore, according to this, by discharging the liquid received by the first recess portion 37 from the first receiving portion 33 through the discharge port 41, it is possible to reduce a concern that the liquid may overflow from the first receiving portion 33.

4. The mounting unit 18 includes the detecting portion 63 that detects the liquid, and the guide path 64 that guides the liquid discharged from the discharge port 41 to the detecting portion 63. According to this, the guide path 64 guides the liquid received by the first recess portion 37 to the detecting portion 63, whereby the detecting portion 63 can detect the liquid received by the first recess portion 37. In this way, the liquid leakage can be detected.

5. The first receiving portion 33 has the absorber 43 that absorbs the liquid, at the position which is in contact with the second recess portion 38. According to this, the liquid received by the second recess portion 38 is absorbed by the absorber 43. In this way, it is possible to reduce a concern that the liquid due to the liquid dripping may overflow from the first receiving portion 33.

This embodiment can be modified and implemented as follows. This embodiment and the following modification examples can be implemented in combination with each other within a technically consistent range.

Figure 12:
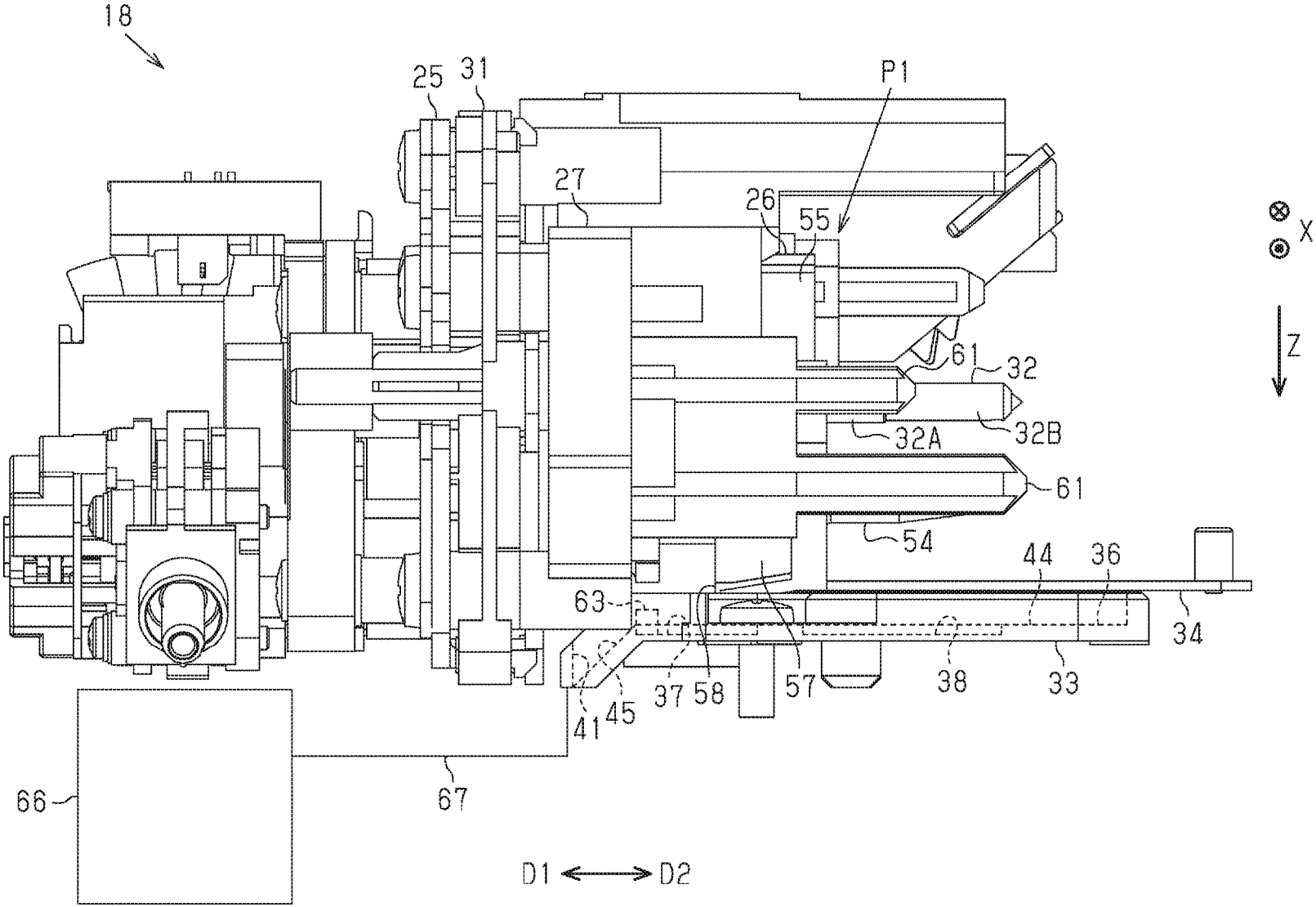
FIG. 12 is a side view showing a modification example of the mounting unit.

As shown in FIG. 12, the mounting unit 18 may include a second receiving portion 66 that receives the liquid discharged from the discharge port 41. In this modification example, the mounting unit 18 further includes a connection path 67. The second receiving portion 66 stores the received liquid. The volume of the second receiving portion 66 is larger than the volume of the first receiving portion 33.

The connection path 67 is connected to the discharge port 41 and the second receiving portion 66. The connection path 67 is a flow path through which the liquid discharged from the discharge port 41 flows. The connection path 67 extends, for example, while being inclined downward from the discharge port 41 toward the second receiving portion 66. In this way, the connection path 67 guides the liquid discharged from the discharge port 41 to the second receiving portion 66. As a result, the second receiving portion 66 stores a large amount of liquid due to the liquid leakage. According to this modification example, the following effect can be obtained.

6. The liquid received by the first recess portion 37 can be held by the second receiving portion 66. In this way, a concern that the liquid may leak from the mounting unit 18 can be reduced.

In the modification example shown in FIG. 12, the mounting unit 18 may be provided with the detecting portion 63 in the first recess portion 37. The liquid leakage can be detected by the detection by the detecting portion 63. According to this modification example, the following effect can be obtained.

7. The detecting portion 63 detects the liquid received by the first recess portion 37, whereby the liquid leakage can be detected.

In the modification example shown in FIG. 12, the mounting unit 18 may be configured such that the second receiving portion 66 directly receives the liquid falling from the discharge port 41 without being provided with the connection path 67. In this case, for example, the second receiving portion 66 is disposed immediately below the discharge port 41.

In the modification example shown in FIG. 12, the second receiving portion 66 may be provided for each mounting unit 18, or may be shared by a plurality of mounting units 18. When the second receiving portion 66 is shared by a plurality of mounting units 18, the second receiving portion 66 stores a plurality of types of liquids.

In the modification example shown in FIG. 12, a pump may be provided in the connection path 67. In this case, the liquid discharged from the discharge port 41 is guided to the second receiving portion 66 by the drive of the pump.

Figure 13:
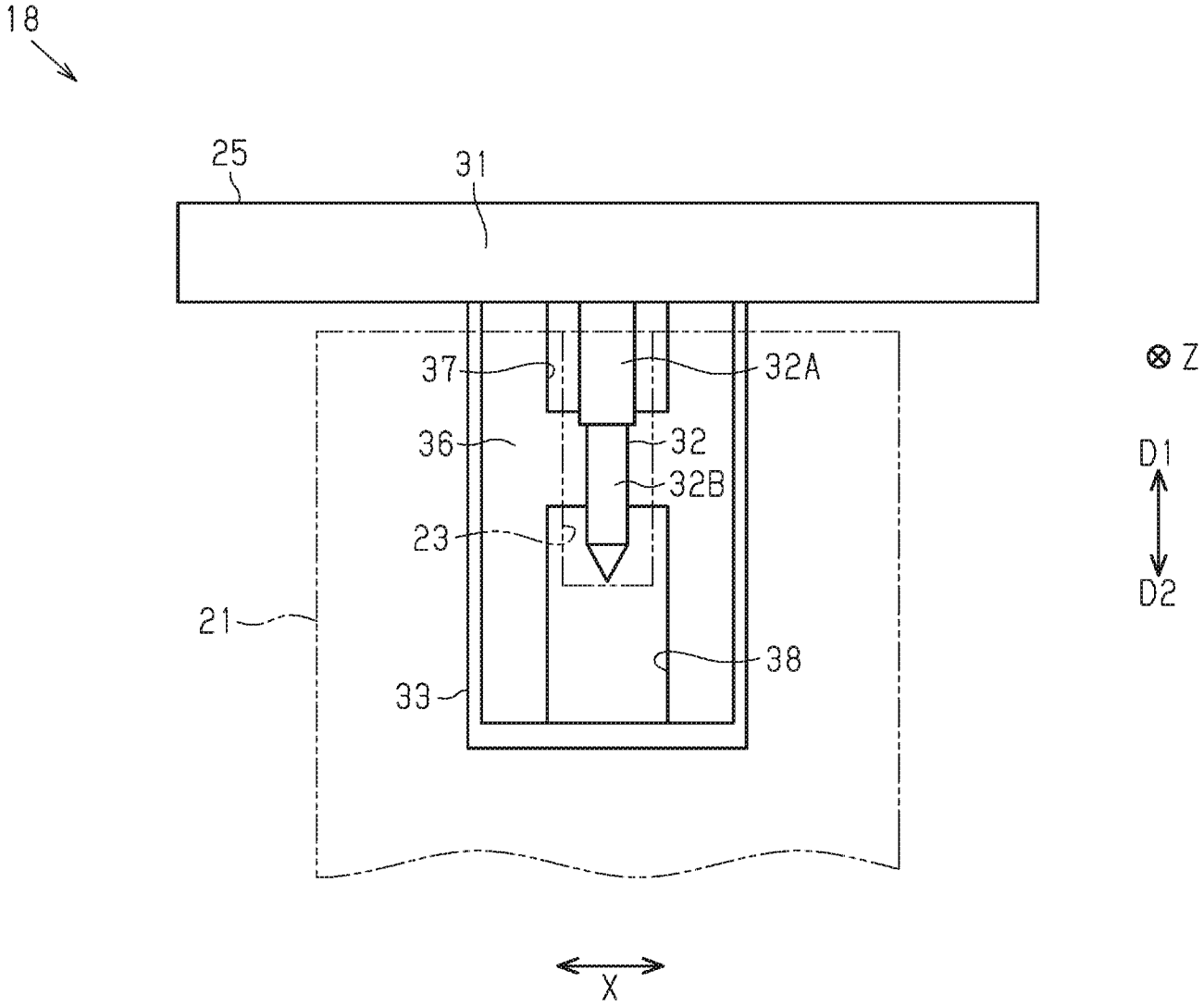
FIG. 13 is a top view showing a modification example different from that of FIG. 12.

As shown in FIG. 13, the mounting unit 18 may be configured such that the first receiving portion 33 directly receives the liquid falling from the liquid container 21 or the liquid introduction portion 32 without being provided with the slider 26.

When the liquid container 21 is mounted to the mounting portion 25, the liquid container 21 is located at the position where it is pushed with respect to the liquid introduction portion 32, as compared with when the liquid container 21 is removed from the mounting portion 25. Therefore, if the liquid leakage occurs, the liquid falls toward the position closer to the base end of the liquid introduction portion 32 in the mounting direction D1 with respect to the first receiving portion 33. As a result, the liquid due to the liquid leakage is received in the first recess portion 37 located at the position displaced in the mounting direction D1 from the second recess portion 38. That is, the liquid due to the liquid leakage is received in the first recess portion 37 provided at the position closer to the base end of the liquid introduction portion 32 than the second recess portion 38 is in the mounting direction D1. When the first recess portion 37 is located, for example, immediately below the base end portion 32A, it is easy to receive the liquid due to the liquid leakage.

When the liquid container 21 is removed from the mounting portion 25, the liquid container 21 is located at the position where it is pulled out with respect to the tip portion 32B of the liquid introduction portion 32, as compared with when the liquid container 21 is mounted to the mounting portion 25. Therefore, when the liquid dripping occurs, the liquid falls toward the position closer to the tip of the liquid introduction portion 32 in the mounting direction D1 with respect to the first receiving portion 33. As a result, the liquid due to the liquid dripping is received in the second recess portion 38 located at the position displaced in the removal direction D2 from the first recess portion 37. That is, the liquid due to the liquid dripping is received in the second recess portion 38 provided at the position closer to the tip of the liquid introduction portion 32 than the first recess portion 37 is in the mounting direction D1. When the second recess portion 38 is located, for example, immediately below the tip portion 32B, it is easy to receive the liquid due to the liquid dripping.

According to this modification example, the following effect can be obtained.

8. The first receiving portion 33 has the first recess portion 37 for receiving the liquid due to the liquid leakage, and the second recess portion 38 for receiving the liquid due to the liquid dripping. According to this, for example, by confirming whether the first recess portion 37 receives the liquid or the second recess portion 38 receives the liquid, it is possible to distinguish between the liquid leakage and the liquid dripping.

The bottom surface of the first recess portion 37 may be inclined downward in the mounting direction D1. In this case, even if the first groove 47 is not provided, the liquid received in the first recess portion 37 is easily guided to the discharge port 41. When the first groove 47 is provided in the first recess portion 37, the liquid received in the first recess portion 37 is more easily guided to the discharge port 41.

The bottom surface of the second recess portion 38 may be inclined downward in the removal direction D2. In this case, even if the second groove 49 is not provided, the liquid received in the second recess portion 38 is easily guided to the absorber 43. When the second groove 49 is provided in the second recess portion 38, the liquid received in the second recess portion 38 is more easily guided to the absorber 43.

The second surface 45 may be a horizontal surface like the first surface 44.

The mounting unit 18 may be configured such that a plurality of liquid accommodation bodies 21 can be mounted. For example, the mounting unit 18 may be provided with a plurality of liquid introduction portions 32.

One first receiving portion 33 may be configured to receive a plurality of types of liquids. For example, one first receiving portion 33 may be shared by a plurality of mounting units 18.

The detecting portion 63 may be provided for each mounting unit 18, or may be shared by a plurality of mounting units 18. When the detecting portion 63 is shared by a plurality of mounting units 18, each of the guide paths 64 included in the plurality of mounting units 18 extends from each of the discharge ports 41 toward one detecting portion 63.

A pump may be provided in the guide path 64. In this case, the liquid which is discharged from the discharge port 41 is guided to the detecting portion 63 by the drive of the pump.

The absorber 43 may be disposed such that the absorber 43 receives the liquid due to the liquid dripping. In this case, for example, the absorber 43 may be disposed so as to be fitted into the second recess portion 38. Further, the absorber 43 may be disposed so as to cover the second recess portion 38. Further, the absorber 43 may receive the liquid due to the liquid dripping without providing the second recess portion 38.

The liquid that is ejected by the liquid ejection head 13 is not limited to ink and may be, for example, a liquid material or the like, in which particles of a functional material are dispersed or mixed in a liquid. For example, the liquid ejection head 13 may eject a liquid material containing a material such as an electrode material or a pixel material which is used for the manufacturing of a liquid crystal display, an electroluminescence display, or a surface emitting display in a dispersed or dissolved manner.

2. Embodiment 2

2.1 Overview of Ink Jet Recording Apparatus

Figure 14:
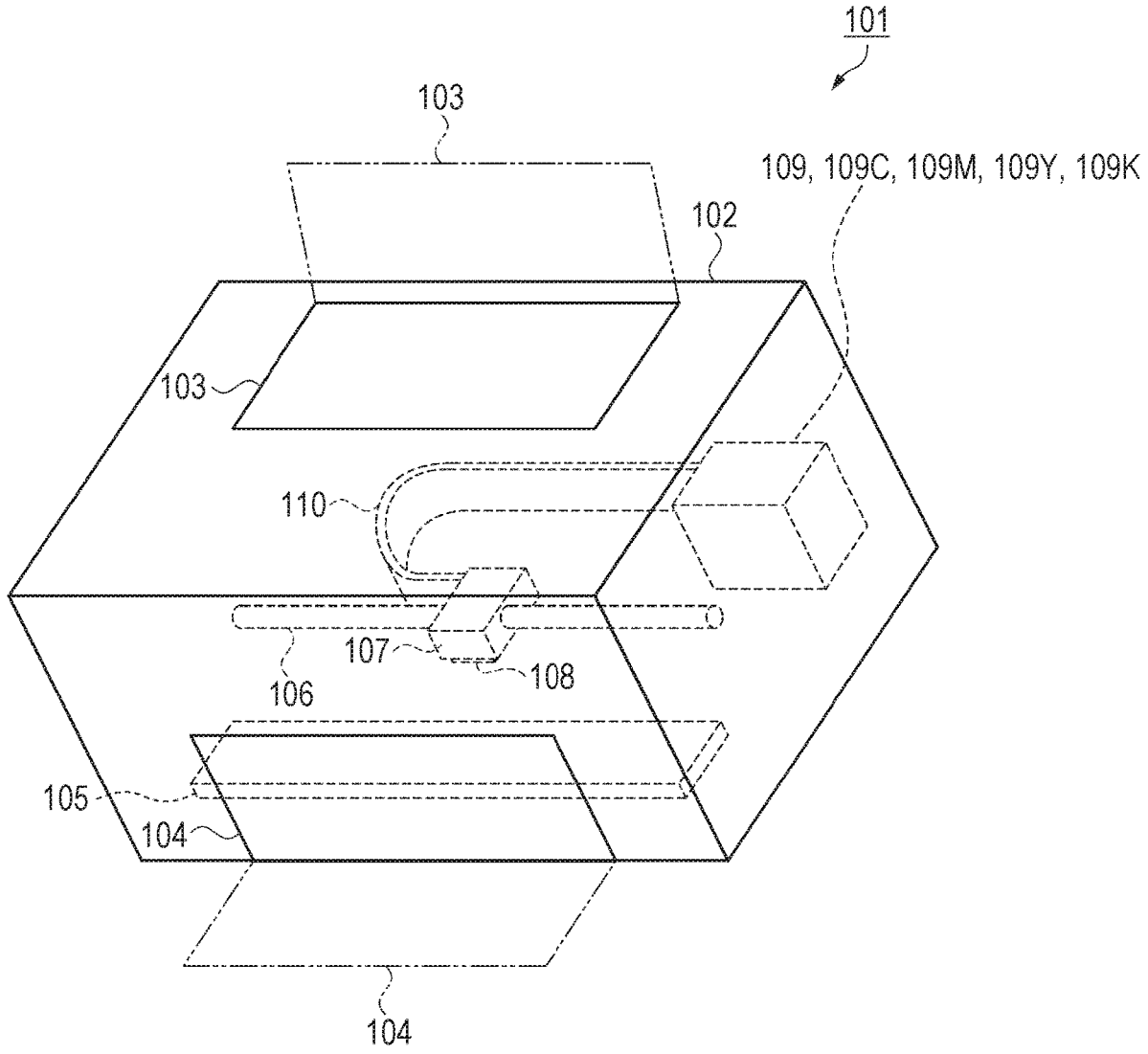
FIG. 14 is a schematic diagram of an ink jet recording apparatus according to Embodiment 2.

As shown in FIG. 14, an ink jet recording apparatus 101, which is an example of a liquid ejection apparatus, has a paper feed tray 103 for taking in recording paper, which is provided at the upper rear portion of a casing 102, and a paper ejection tray 104 for discharging the recorded recording paper, which is provided on the front surface of the casing 102. The recording paper taken from the paper feed tray 103 into the casing 102 passes over a platen 105 provided inside the casing 102 and is discharged to the paper ejection tray 104. Although illustration is omitted, a feeding device that takes the recording paper loaded in the paper feed tray 103 into the casing 102 one by one, a transport device that feeds the taken-in recording paper onto the platen 105, and a discharge device that sends the recording paper, which has passed through the platen 105, onto the paper ejection tray 104 are provided in the casing 102.

In the casing 102, a guide member 106 is disposed above the platen 105 in parallel with the platen 105. The guide member 106 is a member extending in the width direction of the recording paper and supports a carriage 107. The carriage 107 is guided by the guide member 106 and reciprocates in the extending direction of the guide member 106 (the width direction of the recording paper). A recording head 108, which is an example of a liquid ejection head, is mounted to the lower surface of the carriage 107. The recording head 108 ejects ink, which is an example of a liquid, onto the recording paper on the platen 105 while reciprocating in the width direction of the recording paper together with the carriage 107. Although illustration is omitted, a driving mechanism for reciprocating the carriage 107 is provided in the casing 102.

In this manner, the ink jet recording apparatus 101 according to this embodiment is provided with the recording head 108 that ejects ink.

An ink cartridge 109, which is an example of a liquid accommodation section, is provided in the casing 102, and ink is accommodated in the ink cartridge 109. That is, the ink jet recording apparatus 101 according to this embodiment is provided with the ink cartridge 109 in which ink is accommodated.

The ink cartridge 109 has an ink cartridge 109C in which cyan ink is accommodated, an ink cartridge 109M in which magenta ink is accommodated, an ink cartridge 109Y in which yellow ink is accommodated, and an ink cartridge 109K in which black ink is accommodated. That is, the ink cartridge 109 accommodates ink of four colors, which are cyan ink, magenta ink, yellow ink, and black ink.

The number of colors of ink which is accommodated in the ink cartridge 109 is not limited to four colors and may be more than four colors or less than four colors.

The recording head 108 and the ink cartridge 109 are connected by a flow path member 110. That is, the ink jet recording apparatus 101 according to this embodiment is provided with the flow path member 110 that connects the recording head 108 and the ink cartridge 109.

The ink accommodated in the ink cartridge 109 is supplied to the recording head 108 mounted to the carriage 107 through the flow path member 110.

Figure 15:
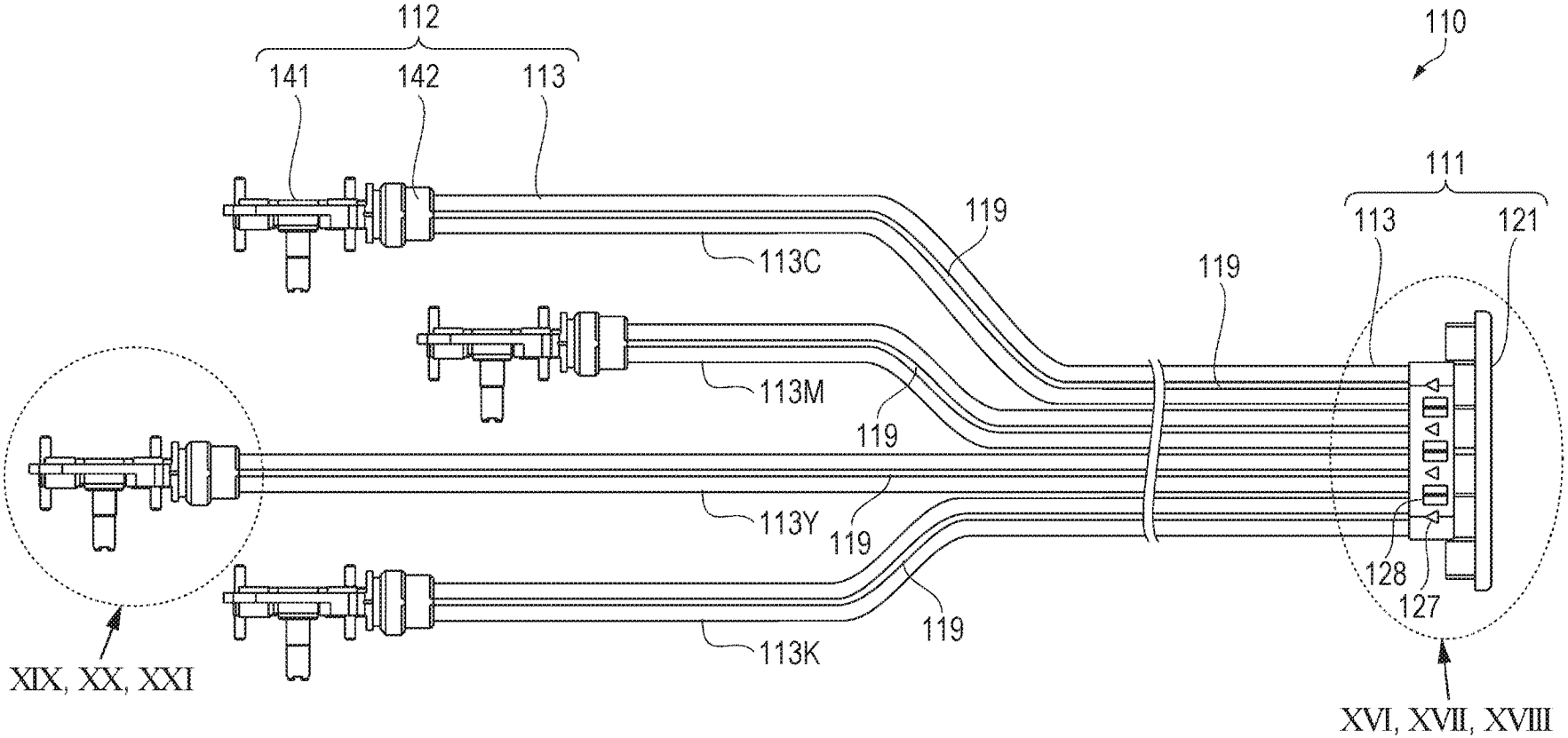
FIG. 15 is a plan view of a flow path member according to Embodiment 2.

As shown in FIG. 15, the flow path member 110 is configured to include one first flow path member 111 and four second flow path members 112.

Figure 16:
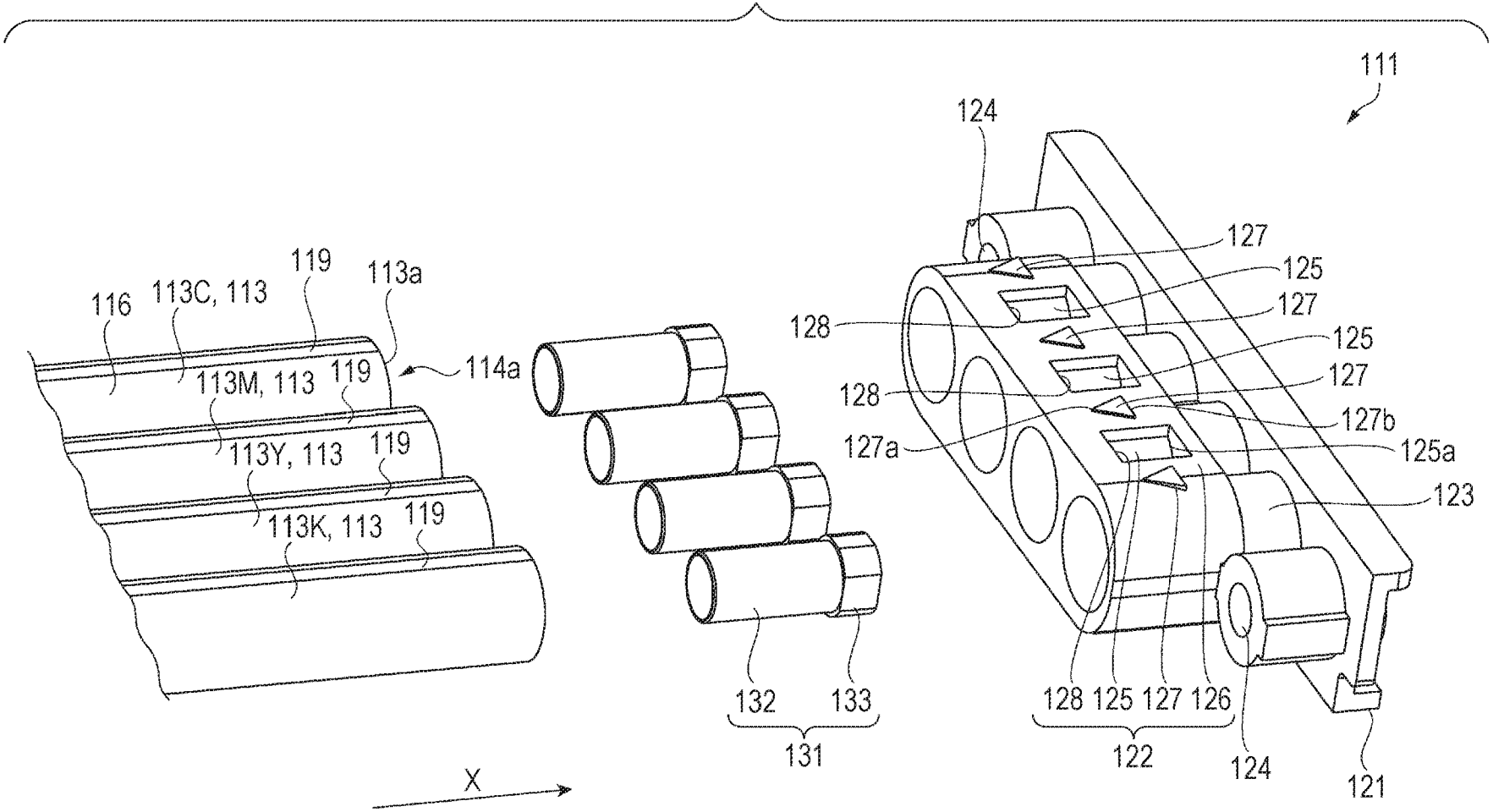
FIG. 16 is an exploded perspective view of a first flow path member in a region XVI, XVII, XVIII surrounded by a broken line in FIG. 15.

The first flow path member 111 includes four flexible tubes 113, one first molded body 121 into which the four flexible tubes 113 are inserted and which functions as a first joint member, and four tubular bodies 131 (refer to FIG. 16). The second flow path member 112 includes one flexible tube 113, one second joint member 141 into which the one flexible tube 113 is inserted, and one second molded body 142 which is disposed so as to cover the flexible tube 113.

In this manner, the flow path member 110 includes the one first flow path member 111, the four second flow path members 112, and the flexible tube 113 that makes the first flow path member 111 and each of the second flow path members 112 communicate with each other.

In the flow path member 110, the first flow path member 111 (the first molded body 121) is connected to the ink cartridge 109, and the second flow path member 112 (the second joint member 141) is connected to the recording head 108. Further, the first molded body 121 is a first joint member that connects the flexible tube 113 and the ink cartridge 109.

The first molded body 121 is mounted to the ink cartridge 109, and even if the carriage 107 reciprocates in the width direction of the recording paper, the position of the first molded body 121 does not change. The second joint member 141 is mounted to the recording head 108, and when the carriage 107 reciprocates in the width direction of the recording paper, the second joint member 141 reciprocates together with the carriage 107, and thus the position of the second joint member 141 changes.

The flexible tube 113 having one end portion 113*a* (refer to FIG. 16) which is connected to the first molded body 121 and the other end portion 113*b* (refer to FIG. 19) which is connected to the second joint member 141 is repeatedly bent or extended according to the reciprocation of the recording head 108.

The flow path member 110 may be made such that the first molded body 121 is connected to a downstream end of an upstream flow path member (not shown) which is connected to the ink cartridge 109 and the second joint member 141 is connected to an upstream end of a downstream flow path member (not shown) which is connected to the recording head 108.

2.2 Overview of First Flow Path Member

Figure 17:
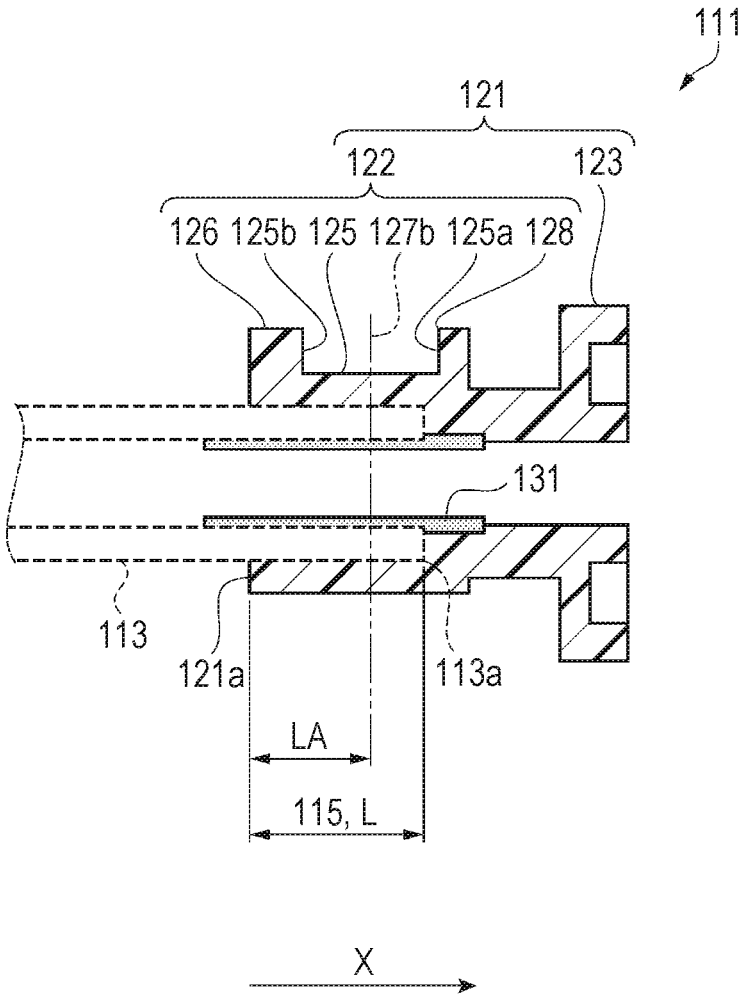
FIG. 17 is a sectional view of a main section of the first flow path member in the region XVI, XVII, XVIII surrounded by a broken line in FIG. 15.
Figure 18:
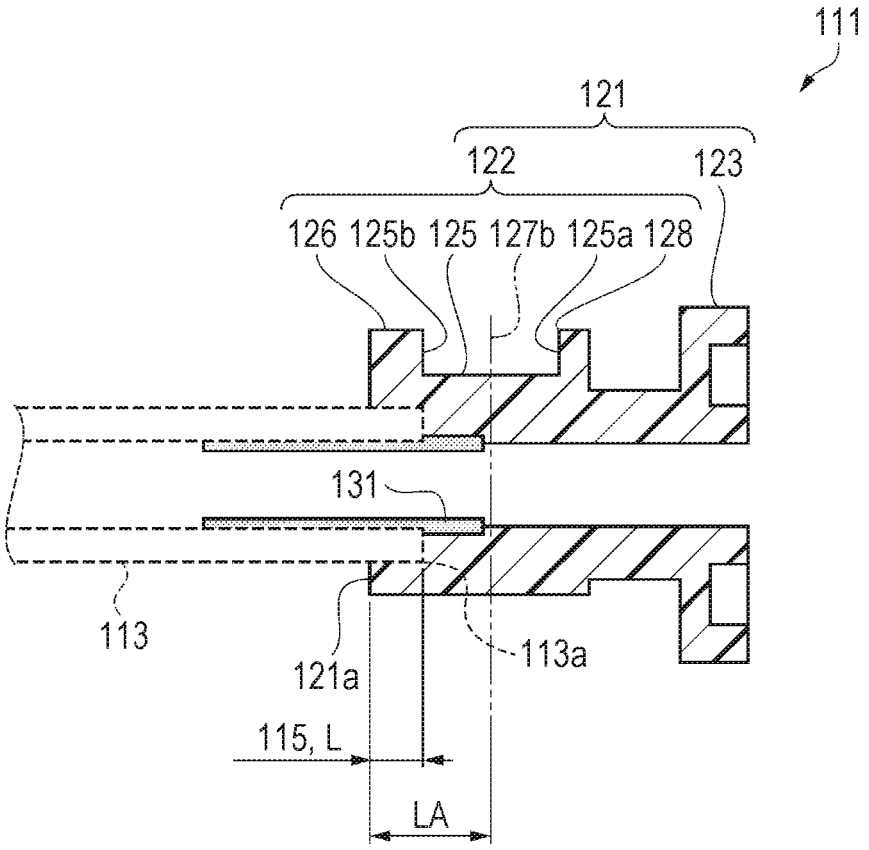
FIG. 18 is a sectional view of a main section of another first flow path member in the region XVI, XVII, XVIII surrounded by a broken line in FIG. 15.

FIG. 16 is an exploded perspective view of the first flow path member 111 in a region XVI, XVII, XVIII surrounded by a broken line in FIG. 15. FIGS. 17 and 18 are sectional views of the main section of the first flow path member 111 in the region XVI, XVII, XVIII surrounded by a broken line in FIG. 15. In FIG. 17, a state when the first molded body 121 is properly formed integrally with the flexible tube 113 is shown. In FIG. 18, a state when the first molded body 121 is not properly formed integrally with the flexible tube 113 is shown. Further, in FIGS. 17 and 18, the flexible tube 113 is shown by a broken line, the first molded body 121 is hatched, and the tubular body 131 is shaded.

In the following description, a direction in which the flexible tube 113 is inserted into an insertion portion 122 of the first molded body 121 is referred to as a +X direction. Further, the tip side of an arrow indicating a direction is defined as a + direction, and the base end side of the arrow indicating a direction is defined as a − direction.

An X direction (+X direction, −X direction) is an example of the longitudinal direction in the present application, and is a direction in which the flexible tube 113 extends.

Next, an overview of the first flow path member 111 will be described with reference to FIGS. 16 to 18.

As shown in FIG. 16, the first flow path member 111 includes four flexible tubes 113, one first molded body 121 that serves as a first joint member, and four tubular bodies 131. That is, the first flow path member 111 has the same number of flexible tubes 113 and tubular bodies 131 as the number of colors of ink which is accommodated in the ink cartridge 109.

The four flexible tubes 113 include a flexible tube 113C which is connected to the ink cartridge 109C in which cyan ink is accommodate, a flexible tube 113M which is connected to the ink cartridge 109M in which magenta ink is accommodated, a flexible tube 113Y which is connected to the ink cartridge 109Y in which yellow ink is accommodated, and a flexible tube 113K which is connected to the ink cartridge 109K in which black ink is accommodated.

The flexible tube 113 has an outer peripheral surface 116, the end portion 113*a* that is an end on the +X direction side, and an end surface 114*a* that is an end on the +X direction side and intersects the outer peripheral surface 116. A line-shaped mark 119 extending from the end portion 113*a* in the longitudinal direction (the X direction) of the flexible tube 113 is formed on the outer peripheral surface 116 of the flexible tube 113.

In this manner, the flexible tube 113 in the first flow path member 111 has the line-shaped mark 119 extending from the end portion 113*a* in the longitudinal direction (the X direction) of the flexible tube 113.

The flexible tube 113 is made of white thermoplastic elastomer, and thus the color of the flexible tube 113 is white.

The color of the line-shaped mark 119 formed on the flexible tube 113C is a color indicating the ink flowing in the flexible tube 113C and is cyan. The color of the line-shaped mark 119 formed on the flexible tube 113M is a color indicating the ink flowing in the flexible tube 113M and is magenta. The color of the line-shaped mark 119 formed on the flexible tube 113Y is a color indicating the ink flowing in the flexible tube 113Y and is yellow. The color of the line-shaped mark 119 formed on the flexible tube 113K is a color indicating the ink flowing in the flexible tube 113K and is black.

In this manner, the color of the line-shaped mark 119 is different in each of the plurality of flexible tubes 113 (the four flexible tubes 113).

The color of the line-shaped mark 119 formed on the flexible tube 113 is a color indicating the ink flowing in the flexible tube 113, and the color of the ink flowing in the flexible tube 113 can be found out at a glance by the line-shaped mark 119. Therefore, for example, when the flexible tube 113 is routed inside the casing 102, it becomes easy to correctly route the flexible tube 113 to an intended portion. For example, when the first molded body 121 to which the flexible tube 113 is connected is connected to the ink cartridge 109, it becomes easy to correctly connect the first molded body 121 to the ink cartridge 109 in which the ink of an intended color is accommodated.

The first molded body 121 is made of thermoplastic resin. In this embodiment, the first molded body 121 is made of white polypropylene resin, and thus the color of the first molded body 121 is white.

The first molded body 121 has the insertion portion 122 into which the flexible tube 113 is inserted, a connection portion 123 which is connected to the ink cartridge 109, and a screw hole 124 into which a screw (not shown) is inserted. Two screw holes 124 are provided such that the connection portion 123 is interposed therebetween.

When screws are inserted into the screw holes 124 and the first molded body 121 and the ink cartridge 109 are fixed to each other by the screws, each of the four flexible tubes 113 is connected to the ink cartridge 109 in which ink of an intended color is accommodated.

The insertion portion 122 has a thick portion 126 having a thick thickness, and a thin portion 125 having a thinner thickness than the thick portion 126. In the insertion portion 122, for example, a portion having a thickness of 2.5 mm or less is the thin portion 125, and a portion having a thickness greater than 2.5 mm is the thick portion 126.

In a state where the flexible tube 113 is inserted into the insertion portion 122, when the thickness of the insertion portion 122 is 2.5 mm or less, it becomes easy for a worker to visually recognize the flexible tube 113 in the insertion portion 122, and when the thickness of the insertion portion 122 is greater than 2.5 mm, it becomes difficult for a worker to visually recognize the flexible tube 113 in the insertion portion 122. Therefore, when the thin portion 125 having a thickness of 2.5 mm or less is provided in the insertion portion 122, a worker can visually recognize the flexible tube 113 inserted into the insertion portion 122 through the thin portion 125.

The thin portion 125 is a visual recognition portion that allows the flexible tube 113 to be visually recognized, and thus a worker can visually recognize the flexible tube 113 through the thin portion 125. That is, the first molded body 121 has the thin portion 125 and the thick portion 126 as a covering portion that covers the end portion 113*a* of the flexible tube 113, and the covering portion has a visual recognition portion (the thin portion 125) at which the position of the end portion 113*a* of the flexible tube 113 can be visually recognized. In other words, the visual recognition portion is configured by the thin portion 125 that is thinner than the thick portion 126 in the first molded body 121.

In the first molded body 121, the thin portion 125 of the insertion portion 122 is provided to correspond to each of the four flexible tubes 113. Further, the thin portion 125 has an end 125*a* on the +X direction side, and an end 125*b* (refer to FIG. 17) on the −X direction side.

An opening 128 that exposes one thin portion 125 among the four thin portions 125 and the thin portion 125 adjacent to the one thin portion 125 is provided in the thick portion 126 of the insertion portion 122. The number of openings 128 which are provided in the thick portion 126 of the insertion portion 122 is three.

A worker can visually recognize the flexible tube 113 through the opening 128 and the thin portion 125.

In this embodiment, one opening 128 is provided between the two flexible tubes 113, and the two flexible tubes 113 can be visually recognized through the one opening 128.

A mark 127 serving as a sign is formed on the thick portion 126 of the insertion portion 122. That is, the insertion portion 122 has the mark 127 serving as a sign. In other words, the first molded body 121 has the mark 127 serving as a sign at the position adjacent to the thin portion 125 as the visual recognition portion. The shape of the mark 127 is a triangle pointed in the −X direction, and has a vertex 127*a* which is disposed on the −X direction side and a base 127*b* which is disposed on the +X direction side. The color of the mark 127 may be different from the color (white) of the thick portion 126 in order for a worker to easily grasp the mark 127.

When viewed from the direction intersecting the X direction, the mark 127 is disposed between the end 125*a* on the +X direction side of the thin portion 125 and the end 125*b* on the −X direction side of the thin portion 125.

The tubular body 131 is made of metal or resin. The tubular body 131 has a first portion 132 which is disposed inside the flexible tube 113, and a second portion 133 which is disposed outside the flexible tube 113. The first portion 132 of the tubular body 131 is inserted into the flexible tube 113. The first portion 132 of the tubular body 131 supports the flexible tube 113 from the inside such that the flexible tube 113 is not deformed.

The first molded body 121 is formed by outsert molding.

Specifically, after the first portion 132 of the tubular body 131 is inserted into the flexible tube 113, the flexible tube 113 with the tubular body 131 inserted therein is set in a mold (not shown), and molten thermoplastic resin is poured into the mold. When the molten thermoplastic resin is poured into the mold, the thermoplastic resin and the constituent material (thermoplastic elastomer) of the flexible tube 113 are melted and mixed together at the interface. When the mold is cooled to cure the thermoplastic resin and the cured thermoplastic resin is removed from the mold, the outsert-molded first molded body 121 is formed.

Then, at a portion 115 (refer to FIG. 17) of the flexible tube 113, which is in contact with the first molded body 121, the flexible tube 113 is integrated with the first molded body 121 and the flexible tube 113 is melt-bonded to the first molded body 121.

The portion 115 of the flexible tube 113, which is in contact with the first molded body 121, is an example of the portion that is integrated with the first molded body, of the flexible tube in the present application.

In FIGS. 17 and 18, the position of the base 127*b* of the mark 127 is shown by a thick two-dot chain line.

As shown in FIGS. 17 and 18, the first molded body 121 which is integrally formed with the flexible tube 113 in a state of covering the end portion 113*a* of the flexible tube 113 and serves as a first joint member is formed by the outsert molding described above. A plurality of flexible tubes 113 (four flexible tubes 113) are integrally formed at the first molded body 121.

Further, the first molded body 121 is formed with the thin portion 125 through which the flexible tube 113 can be visually recognized, and the thick portion 126. The thick portion 126 of the first molded body 121 is formed with the opening 128 that exposes the thin portion 125, and the mark 127 that serves as a sign (not shown in FIGS. 17 and 18).

The tubular body 131 is inserted into the flexible tube 113 and supports the portion 115 of the flexible tube 113, which is in contact with the first molded body 121, from the inside. That is, the tubular body 131 is inserted into the flexible tube 113 and supports the portion integrated with the first molded body 121, of the flexible tube 113, from the inside.

As a result, when the first molded body 121 is formed by the outsert molding, the deformation of the portion 115 of the flexible tube 113, which is in contact with the first molded body 121, is suppressed.

In the X direction, the distance between the end 121*a* on the −X direction side of the first molded body 121 and the base 127*b* of the mark 127 formed on the first molded body 121 is LA. Further, in the X direction, the distance between the end 121*a* on the −X direction side of the first molded body 121 and the end portion 113*a* on the +X direction side of the flexible tube 113 is L. That is, the length in the X direction of the portion 115 of the flexible tube 113, which is in contact with the first molded body 121, is L.

Since the flexible tube 113 is repeatedly bent or extended according to the reciprocation of the carriage 107, a force repeatedly acts on the portion 115 of the flexible tube 113, which is in contact with the first molded body 121, that is, the portion where the first molded body 121 and the flexible tube 113 are bonded together. When the adhesive strength between the first molded body 121 and the flexible tube 113 is strong, even if the flexible tube 113 is repeatedly bent or extended, the adhesion between the first molded body 121 and the flexible tube 113 is maintained, and the adhesion between the first molded body 121 and the flexible tube 113 is not released. However, if the adhesive strength between the first molded body 121 and the flexible tube 113 is weak, when the flexible tube 113 is repeatedly bent or extended, there is a concern that the adhesion between the first molded body 121 and the flexible tube 113 may be easily released.

In this embodiment, when the length L in the X direction of the portion 115 of the flexible tube 113, which is in contact with the first molded body 121, is equal to or greater than the distance LA, the adhesive strength between the first molded body 121 and the flexible tube 113 becomes strong, and thus even if the flexible tube 113 is repeatedly bent or extended, the adhesion between the first molded body 121 and the flexible tube 113 is maintained, and the adhesion between the first molded body 121 and the flexible tube 113 is not easily released.

That is, if in the X direction, the end portion 113*a* on the +X direction side of the flexible tube 113 is disposed at the position separated by the distance LA or more with the end 121*a* on the −X direction side of the first molded body 121 as a reference, the adhesive strength between the first molded body 121 and the flexible tube 113 becomes strong, and thus even if the flexible tube 113 is repeatedly bent or extended, the adhesion between the first molded body 121 and the flexible tube 113 is maintained, and the adhesion between the first molded body 121 and the flexible tube 113 is not easily released.

In the X direction, the base 127*b* of the mark 127 is disposed at the position separated by the distance LA with the end 121*a* on the −X direction side of the first molded body 121 as a reference.

Then, if the end portion 113*a* on the +X direction side of the flexible tube 113 is disposed on the +X direction side with respect to the base 127*b* of the mark 127, in the X direction, the end portion 113*a* on the +X direction side of the flexible tube 113 is disposed at the position separated by the distance LA or more with the end 121*a* on the −X direction side of the first molded body 121 as a reference, and the length L in the X direction of the portion 115 of the flexible tube 113, which is in contact with the first molded body 121, becomes equal to or greater than the distance LA. In this case, the adhesive strength between the first molded body 121 and the flexible tube 113 becomes strong, and thus even if the flexible tube 113 is repeatedly bent or extended, the adhesion between the first molded body 121 and the flexible tube 113 is maintained, and the adhesion between the first molded body 121 and the flexible tube 113 is not easily released.

That is, when the first molded body 121 is properly formed integrally with the flexible tube 113, the end portion 113*a* on the +X direction side of the flexible tube 113 is disposed on the +X direction side with respect to the base 127*b* of the mark 127.

On the other hand, if the end portion 113*a* on the +X direction side of the flexible tube 113 is disposed on the −X direction side with respect to the base 127*b* of the mark 127, in the X direction, the end portion 113*a* on the +X direction side of the flexible tube 113 is not disposed at the position separated by the distance LA or more with the end 121*a* on the −X direction side of the first molded body 121 as a reference, and thus the length L in the X direction of the portion 115 of the flexible tube 113, which is in contact with the first molded body 121, becomes shorter than the distance LA. In this case, the adhesive strength between the first molded body 121 and the flexible tube 113 becomes weak, and thus if the flexible tube 113 is repeatedly bent or extended, there is a concern that the adhesion between the first molded body 121 and the flexible tube 113 may be released.

That is, when the first molded body 121 is not properly formed integrally with the flexible tube 113, the end portion 113*a* on the +X direction side of the flexible tube 113 is disposed on the −X direction side with respect to the base 127*b* of the mark 127.

As shown in FIG. 17, when the first molded body 121 is properly formed integrally with the flexible tube 113, since the length L in the X direction of the portion 115 of the flexible tube 113, which is in contact with the first molded body 121, becomes longer than the distance LA, the adhesive strength between the first molded body 121 and the flexible tube 113 becomes strong, and thus even if the flexible tube 113 is repeatedly bent or extended, the adhesion between the first molded body 121 and the flexible tube 113 is maintained, and the adhesion between the first molded body 121 and the flexible tube 113 is not easily released.

In this case, since the end portion 113*a* on the +X direction side of the flexible tube 113 is disposed on the +X direction side with respect to the mark 127 (the base 127*b* of the mark 127), a worker can visually recognize the flexible tube 113 on the +X direction side with respect to the mark 127 through the thin portion 125.

In this manner, this embodiment has a configuration in which when the first molded body 121 is properly formed integrally with the flexible tube 113, the flexible tube 113 can be visually recognized downstream in the +X direction with respect to the mark 127.

As shown in FIG. 18, when the first molded body 121 is not properly formed integrally with the flexible tube 113, since the length L in the X direction of the portion 115 of the flexible tube 113, which is in contact with the first molded body 121, becomes shorter than the distance LA, the adhesive strength between the first molded body 121 and the flexible tube 113 becomes weak, and thus if the flexible tube 113 is repeatedly bent or extended, there is a concern that the adhesion between the first molded body 121 and the flexible tube 113 may be released.

In this case, since the end portion 113*a* on the +X direction side of the flexible tube 113 is disposed on the −X direction side with respect to the mark 127 (the base 127*b* of the mark 127), a worker cannot visually recognize the flexible tube 113 downstream in the +X direction side with respect to the mark 127 through the thin portion 125.

In this manner, this embodiment has a configuration in which when the first molded body 121 is not properly formed integrally with the flexible tube 113, the flexible tube 113 cannot be visually recognized downstream in the +X direction with respect to the mark 127.

As described above, the first molded body 121 is formed by the outsert molding in which the flexible tube 113 with the tubular body 131 inserted therein is set in a mold and molten thermoplastic resin is poured into the mold.

For example, if the flexible tube 113 with the tubular body 131 inserted therein has irregularities intersecting the X direction, a mold having a fitting portion into which the irregularities are fitted is created, and the flexible tube 113 is set in the mold so as to be fitted into the fitting portion, the flexible tube 113 becomes difficult to move in the X direction in the mold. However, the flexible tube 113 with the tubular body 131 inserted therein is a member long in the X direction and does not have irregularities in the direction intersecting the X direction, and thus it is difficult to set the flexible tube 113 in the mold so as to be fitted into the fitting portion. Therefore, the flexible tube 113 easily moves in the X direction in the mold.

As a result, if the first molded body 121 is formed by the outsert molding, the flexible tube 113 moves in the X direction in the mold, and the length L in the X direction of the portion 115 of the flexible tube 113, which is in contact with the first molded body 121, easily changes.

When the outsert-molded first molded body 121 is in the state shown in FIG. 18 and the first flow path member 111 shown in FIG. 18 is applied to the ink jet recording apparatus 101, that is, when the first flow path member 111 in which the length L of the portion 115 of the flexible tube 113, which is in contact with the first molded body 121, is shorter than the distance LA is applied to the ink jet recording apparatus 101, due to long-term use of the ink jet recording apparatus 101, the adhesion between the first molded body 121 and the flexible tube 113 is released, and thus there is a concern that the ink may leak from the first flow path member 111.

In this embodiment, after the first molded body 121 is formed by the outsert molding, a worker visually confirms the state of the first flow path member 111 and determines the quality of the first flow path member 111.

For example, when the flexible tube 113 is visually recognized downstream in the +X direction with respect to the mark 127, a worker determines that the first molded body 121 is properly formed integrally with the flexible tube 113, and the first flow path member 111 is determined to be a non-defective product. For example, when the flexible tube 113 is not visually recognized downstream in the +X direction with respect to the mark 127, a worker determines that the first molded body 121 is not properly formed integrally with the flexible tube 113, and the first flow path member 111 is determined to be a defective product.

Further, since both the first molded body 121 and the flexible tube 113 are white, if the line-shaped mark 119 of a color different from white is formed on the outer peripheral surface 116 of the flexible tube 113, a worker can easily grasp the position of the flexible tube 113 by the line-shaped mark 119 and appropriately determines the quality of the first flow path member 111.

In this manner, a worker can easily and reliably evaluate the quality of the first flow path member 111 by a simple visual inspection to confirm whether the flexible tube 113 can be visually recognized downstream in the +X direction with respect to the mark 127 or the flexible tube 113 cannot be visually recognized downstream in the +X direction with respect to the mark 127, reliably select the non-defective product of the first flow path member 111, and reliably exclude the defective product of the first flow path member 111.

Of course, the quality of the first flow path member 111 may be automatically evaluated by using a camera or the like, instead of the visual inspection by a worker.

In this embodiment, since the state of the portion where the first molded body 121 and the flexible tube 113 are connected to each other can be visually confirmed, a concern that the first flow path member 111 having a defect at the portion where the first molded body 121 and the flexible tube 113 are connected to each other may be used is suppressed.

Further, since the non-defective first flow path member 111 is reliably used in the ink jet recording apparatus 101, a defect in which ink leaks from the first flow path member 111 when the ink jet recording apparatus 101 is used for a long period of time is suppressed, and the reliability of the ink jet recording apparatus 101 is improved.

2.3 Overview of Second Flow Path Member

Figure 19:
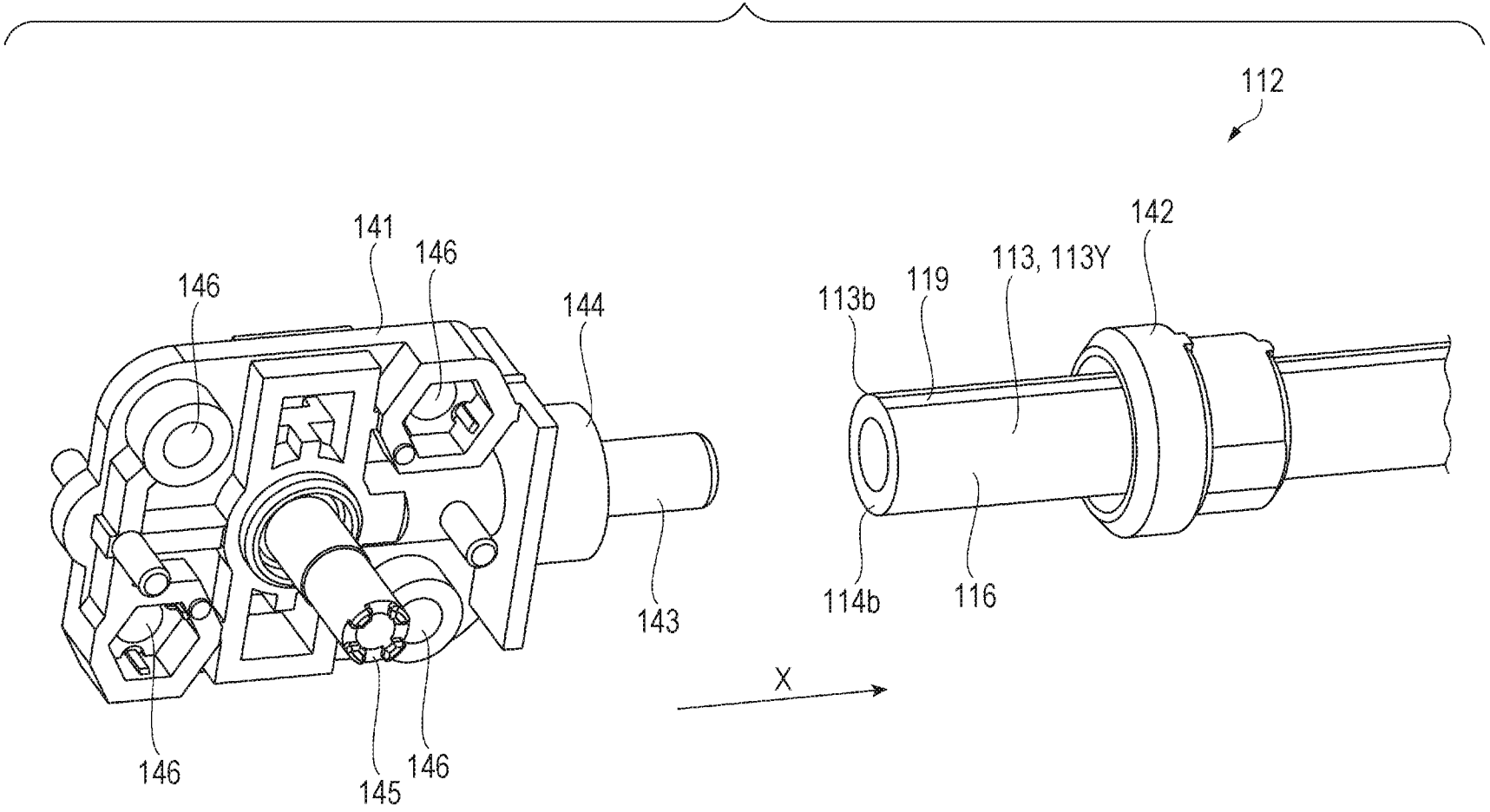
FIG. 19 is an exploded perspective view of a second flow path member in a region XIX, XX, XXI surrounded by a broken line in FIG. 15.
Figure 20:
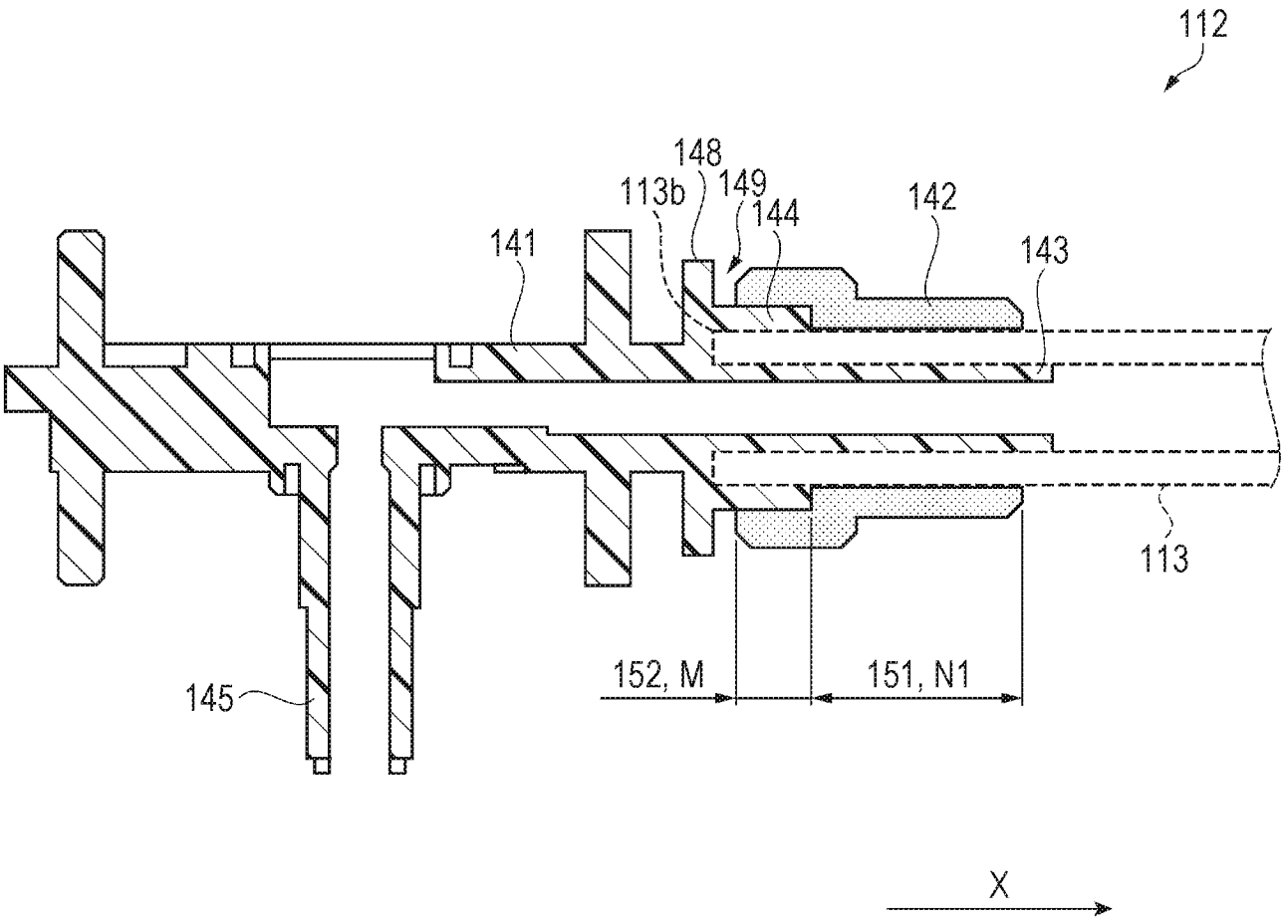
FIG. 20 is a sectional view of a main section of the second flow path member in the region XIX, XX, XXI surrounded by a broken line in FIG. 15.
Figure 21:
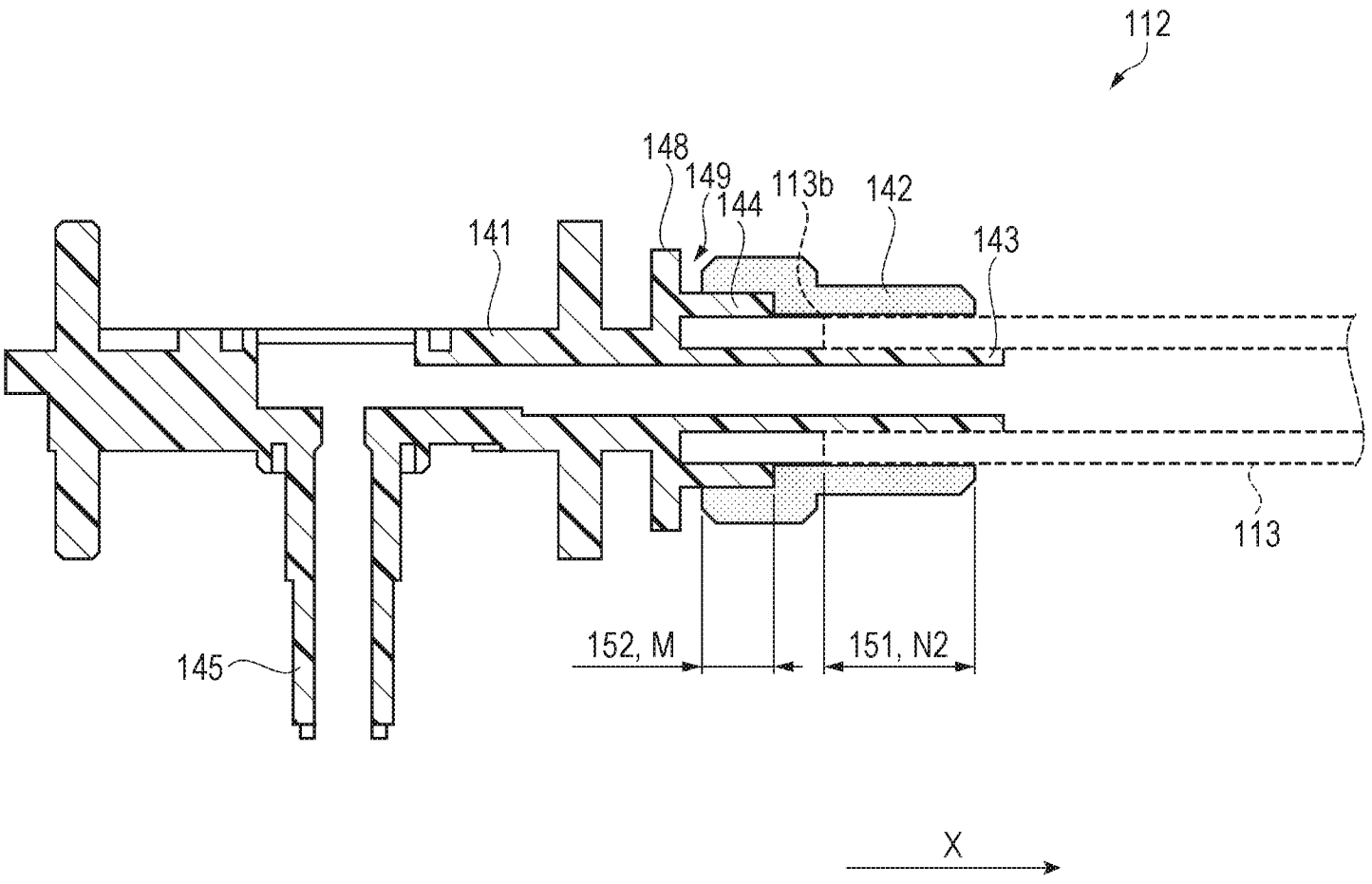
FIG. 21 is a sectional view of a main section of another second flow path member in the region XIX, XX, XXI surrounded by a broken line in FIG. 15.

FIG. 19 is an exploded perspective view of the second flow path member 112 in a region XIX, XX, XXI surrounded by a broken line in FIG. 15. FIGS. 20 and 21 are sectional views of the main section of the second flow path member 112 in the region XIX, XX, XXI surrounded by a broken line in FIG. 15. In FIG. 20, a state where the second molded body 142 is properly formed integrally with the flexible tube 113 is shown. In FIG. 21, a state where the second molded body 142 is not properly formed integrally with the flexible tube 113 is shown. Further, in FIGS. 20 and 21, the flexible tube 113 is shown by a broken line, the second joint member 141 is hatched, and the second molded body 142 is shaded.

Next, an overview of the second flow path member 112 will be described with reference to FIGS. 19 to 21.

As shown in FIG. 19, the second flow path member 112 has one flexible tube 113, one second joint member 141, and one second molded body 142. The flexible tube 113 has the outer peripheral surface 116, the end portion 113*b* that is an end on the −X direction side, and an end surface 114*b* that is an end on the −X direction side and intersects the outer peripheral surface 116.

The second molded body 142 is made of thermoplastic resin. In this embodiment, the second molded body 142 is made of white polypropylene resin, and thus the color of the second molded body 142 is white.

The line-shaped mark 119 extending from the end portion 113*b* in the longitudinal direction (the X direction) of the flexible tube 113 is formed on the outer peripheral surface 116 of the flexible tube 113. The line-shaped mark 119 is formed between the end portion 113*a* that is an end on the +X direction side and the end portion 113*b* that is an end on the −X direction side. The flexible tube 113 shown in FIG. 19 is the flexible tube 113Y through which yellow ink flows, and the color of the line-shaped mark 119 shown in FIG. 19 is yellow.

In this manner, the flexible tube 113 in the second flow path member 112 has the line-shaped mark 119 extending from the end portion 113*b* in the longitudinal direction (the X direction) of the flexible tube 113.

The second joint member 141 is made of white polypropylene resin, and thus the color of the second joint member 141 is white. The second joint member 141 has an insertion portion 143 into which the flexible tube 113 is inserted, a thin portion 144 which is disposed to face the insertion portion 143, a connection portion 145 which is connected to the recording head 108, and a screw hole 146 into which a screw (not shown) is inserted. Four screw holes 146 are provided so as to surround the connection portion 145.

When screws are inserted into the screw holes 146, so that the second joint member 141 and the recording head 108 are fixed to each other by the screw, the connection portion 145 is connected to the recording head 108 and the flexible tube 113 is connected to the recording head 108 through the second joint member 141.

In order to properly connect each of the four flexible tubes 113 through the second joint member 141, as shown in FIG. 15, it is necessary to align the directions of the connection portions 145 of the second joint member 141 in the same direction in the four second joint members 141.

When the line-shaped mark 119 is provided between the end portion 113*a* and the end portion 113*b* of the flexible tube 113, it becomes easy to align the directions of the connection portions 145 of the second joint members 141 in the same direction in the four second joint members 141 with the line-shaped mark 119 as a reference. In addition, when the line-shaped mark 119 is provided between the end portion 113*a* and the end portion 113*b* of the flexible tube 113, a defect such as twisting of the flexible tube 113 can be easily detected.

As shown in FIGS. 20 and 21, the second joint member 141 has, near the second molded body 142, a protrusion portion 148 that protrudes from the insertion portion 143 in the direction intersecting the X direction. Further, the thin portion 144 extending in the +X direction from the protrusion portion 148 is provided to face the insertion portion 143. The thin portion 144 is disposed to face the insertion portion 143, and a space into which the flexible tube 113 can be inserted is formed between the insertion portion 143 and the thin portion 144. Further, when the flexible tube 113 is inserted between the insertion portion 143 and the thin portion 144, the thin portion 144 is disposed so as to cover the end portion 113*b* of the flexible tube 113. That is, in the second joint member 141, the thin portion 144 serves as a covering portion that covers the end portion 113*b* of the flexible tube 113.

The second molded body 142 is disposed to be separated from the protrusion portion 148, so that a gap 149 is formed between the second molded body 142 and the protrusion portion 148. In other words, the second molded body 142 is disposed so as to cover a part of the covering portion. The thin portion 144 can be visually recognized through the gap 149.

The thickness of the thin portion 144 of the second joint member 141 is, for example, 2.5 mm or less, similarly to the thickness of the thin portion 125 of the first molded body 121. When the flexible tube 113 is inserted between the insertion portion 143 and the thin portion 144 and the end portion 113*b* on the −X direction side of the flexible tube 113 is disposed so as to be in contact with the protrusion portion 148, a worker can visually recognize the flexible tube 113 through the gap 149 and the thin portion 144.

The thin portion 144 is a visual recognition portion that allows the flexible tube 113 to be visually recognized, and a worker can visually recognize the flexible tube 113 through the thin portion 144. That is, the visual recognition portion that allows the flexible tube 113 to be visually recognized is formed by the thin portion 144 of the second joint member 141.

Then, the second joint member 141 has the insertion portion 143 into which the flexible tube 113 is inserted, and the thin portion 144 (the visual recognition portion) that is disposed to face the insertion portion 143, covers the flexible tube 113, and allows the flexible tube 113 to be visually recognized.

That is, the second joint member 141 has the thin portion 144 as a covering portion that covers the end portion 113*b* of the flexible tube 113, and the thin portion 144 as the covering portion has a visual recognition portion in which the position of the end portion 113*b* can be visually recognized. In other words, the visual recognition portion is configured by the thin portion 144 of the second joint member 141, which is thinner than other portions.

The second molded body 142 is formed by the outsert molding.

Specifically, after the flexible tube 113 is inserted between the insertion portion 143 and the thin portion 144 of the second joint member 141, the second joint member 141 with the flexible tube 113 inserted therein is set in a mold (not shown) and molten thermoplastic resin is poured into the mold. When the molten thermoplastic resin is poured into the mold, the thermoplastic resin and the constituent material (polypropylene resin) of the second joint member 141, and the thermoplastic resin and the constituent material (thermoplastic elastomer) of the flexible tube 113 are melted and mixed together at the interfaces. When the mold is cooled to cure the thermoplastic resin and the cured thermoplastic resin is removed from the mold, the outsert-molded second molded body 142 is formed.

As shown in FIGS. 20 and 21, at a portion 151 which is in contact with the second molded body 142, of the end portion 113*b* of the flexible tube 113, the flexible tube 113 is integrated with the second molded body 142 and melt-bonded to the second molded body 142. In other words, the second molded body 142 is melt-bonded to the flexible tube 113 in a state of covering the portion 151 that is at least a part of the end portion 113*b* of the flexible tube 113 and is in contact with the second molded body 142.

The portion 151 of the flexible tube 113, which is in contact with the second molded body 142, is a part of the portion that is inserted into the insertion portion, of the flexible tube in the present application. Then, the second molded body 142 is formed integrally with the portion 151 of the flexible tube 113, which is in contact with the second molded body 142 (a part of the portion that is inserted into the insertion portion, of the flexible tube).

Further, at a portion 152 of the second joint member 141, which is in contact with the second molded body 142, the second joint member 141 is integrated with the second molded body 142 and melt-bonded to the second molded body 142. Further, since the portion 152 of the second joint member 141, which is in contact with the second molded body 142, is the thin portion 144, at the portion 152 of the thin portion 144, which is in contact with the second molded body 142, the second joint member 141 is integrated with the second molded body 142 and is melt-bonded to the second molded body 142.

In other words, the second molded body 142 is integrated with the portion 152 of the thin portion 144, which is in contact with the second molded body 142, and is melt-bonded to the second joint member 141.

The portion 152 of the thin portion 144, which is in contact with the second molded body 142, is a part of the visual recognition portion in the present application. Then, the second molded body 142 is formed integrally with the portion 152 (a part of the visual recognition portion) of the thin portion 144, which is in contact with the second molded body 142.

Since the second molded body 142 is integrated with the portion 151 of the flexible tube 113, which is in contact with the second molded body 142, to be melt-bonded to the flexible tube 113, and is integrated with the portion 152 of the thin portion 144, which is in contact with the second molded body 142, to be melt-bonded to the second joint member 141, the flexible tube 113 and the second joint member 141 are bonded together by the second molded body 142 and fixed to each other by the second molded body 142. In this manner, the second flow path member 112 has the second molded body 142 which is formed integrally with the portion 151 of the flexible tube 113, which is in contact with the second molded body 142, and is formed integrally with the portion 152 of the thin portion 144, which is in contact with the second molded body 142. Then, in the second flow path member 112, the flexible tube 113 and the second joint member 141 are fixed to each other by the second molded body 142. That is, the second molded body 142 is fixed in a state of covering at least a part of the end portion 113*b* of the flexible tube 113 and a part of the covering portion.

As described above, the second molded body 142 is formed by the outsert molding in which the second joint member 141 with the flexible tube 113 inserted therein is set in a mold and molten thermoplastic resin is poured into the mold.

Since the second joint member 141 with the flexible tube 113 inserted therein has irregularities (for example, the connection portion 145, the protrusion portion 148, and the like) in the direction intersecting the X direction, when a mold having a fitting portion into which the irregularities are fitted is created and the second joint member 141 with flexible tube 113 inserted therein is set in the mold so as to be fitted into the fitting portion, the second joint member 141 (the thin portion 144) becomes difficult to move in the X direction in the mold.

In the second molded body 142 formed by the outsert molding, the second joint member 141 (the thin portion 144) does not easily move in the X direction in the mold, and therefore, the dimension in the X direction of the portion 152 of the thin portion 144, which is in contact with the second molded body 142, does not easily change.

In this embodiment, the dimension in the X direction of the portion 152 of the thin portion 144, which is in contact with the second molded body 142, has a dimension M in which the adhesion between the second molded body 142 and the second joint member 141 (the thin portion 144) is stably maintained even if the flexible tube 113 is repeatedly bent or extended. Therefore, even if the flexible tube 113 is repeatedly bent or extended, the adhesion between the second molded body 142 and the second joint member 141 is maintained and the adhesion between the second molded body 142 and the second joint member 141 is not easily released.

Further, when the dimension in the X direction of the portion 151 of the flexible tube 113, which is in contact with the second molded body 142, is N1, even if the flexible tube 113 is repeatedly bent or extended, the adhesion between the second molded body 142 and the flexible tube 113 is maintained and the adhesion between the second molded body 142 and the flexible tube 113 is not easily released.

However, since the flexible tube 113 is inserted between the insertion portion 143 and the thin portion 144 by the manual work of a worker, the position in the X direction of the flexible tube 113 with respect to the second joint member 141 easily change due to variation in manual work.

For example, there is a case where a state where the end portion 113*b* of the flexible tube 113 is in contact with the protrusion portion 148 of the second molded body 142, so that the flexible tube 113 is deeply inserted into the insertion portion 143 (the state of FIG. 20), a state where the end portion 113*b* of the flexible tube 113 is separated from the protrusion portion 148 of the second joint member 141, so that the flexible tube 113 is shallowly inserted into the insertion portion 143 (the state of FIG. 21), or the like occurs.

In this manner, in the second molded body 142 formed by the outsert molding, due to variation in the manual work of inserting the flexible tube 113 between the insertion portion 143 and the thin portion 144, the dimension in the X direction of the portion 151 of the flexible tube 113, which is in contact with the second molded body 142, easily changes.

As shown in FIG. 20, when the second molded body 142 is formed in a state where the flexible tube 113 is deeply inserted into the insertion portion 143, the dimension in the X direction of the portion 151 of the flexible tube 113, which is in contact with the second molded body 142, becomes N1. In this case, a worker can visually recognize the flexible tube 113 through the gap 149 and the thin portion 144.

In this manner, in the second flow path member 112, when the flexible tube 113 is visually recognized through the gap 149 and the thin portion 144, the dimension in the X direction of the portion 151 of the flexible tube 113, which is in contact with the second molded body 142, becomes N1.

When the dimension in the X direction of the portion 151 of the flexible tube 113, which is in contact with the second molded body 142, is N1, even if the flexible tube 113 is repeatedly bent or extended, the adhesion between the second molded body 142 and the flexible tube 113 is maintained and the adhesion between the second molded body 142 and the flexible tube 113 is not easily released. Therefore, when the flexible tube 113 is visually recognized through the gap 149 and the thin portion 144, even if the flexible tube 113 is repeatedly bent or extended, the adhesion between the second molded body 142 and the flexible tube 113 is maintained and the adhesion between the second molded body 142 and the flexible tube 113 is not easily released.

That is, when the flexible tube 113 is visually recognized through the gap 149 and the thin portion 144, the second flow path member 112 is regarded as a non-defective product.

In this manner, this embodiment has a configuration in which when the second molded body 142 is properly formed integrally with the flexible tube 113, the flexible tube 113 can be visually recognized through the thin portion 144 (the visual recognition portion).

As shown in FIG. 21, when the flexible tube 113 is shallowly inserted into the insertion portion 143, there is a case where the dimension in the X direction of the portion 151 of the flexible tube 113, which is in contact with the second molded body 142, becomes N2, which is shorter than N1. In this case, a worker cannot visually recognize the flexible tube 113 through the gap 149 and the thin portion 144.

When the dimension in the X direction of the portion 151 of the flexible tube 113, which is in contact with the second molded body 142, is shorter than N1, the adhesive strength between the second molded body 142 and the flexible tube 113 becomes weak, and thus if the flexible tube 113 is repeatedly bent or extended, there is a concern that the adhesion between the second molded body 142 and the flexible tube 113 may be released, and the second flow path member 112 is regarded as a defective product.

Although illustration is omitted, even when the flexible tube 113 is not visually recognized through the gap 149 and the thin portion 144, if the end portion 113*b* of the flexible tube 113 is disposed between the insertion portion 143 and the thin portion 144, the dimension in the X direction of the portion 151 of the flexible tube 113, which is in contact with the second molded body 142, becomes N1. In this case, the second flow path member 112 is regarded as a non-defective product.

Since all the second flow path members 112 in which the flexible tube 113 is visually recognized through the gap 149 and the thin portion 144 are non-defective products, it is preferable to use the non-defective second flow path member 112 in the ink jet recording apparatus 101.

Since the second flow path member 112 in which the flexible tube 113 is not visually recognized through the gap 149 and the thin portion 144 includes a defective product, it is not preferable to use the second flow path member 112 including a defective product in the ink jet recording apparatus 101.

A worker can easily and reliably evaluate the quality of the second flow path member 112 by a simple visual inspection to confirm whether the flexible tube 113 can be visually recognized through the gap 149 and the thin portion 144 or the flexible tube 113 cannot be visually recognized through the gap 149 and the thin portion 144, reliably select the non-defective product of the second flow path member 112, and reliably exclude the defective product of the second flow path member 112.

Further, since both the second molded body 142 and the flexible tube 113 are white, if the line-shaped mark 119 of a color different from white is formed on the outer peripheral surface 116 of the flexible tube 113, a worker can easily grasp the position of the flexible tube 113 by the line-shaped mark 119 and can easily determine the quality of the second flow path member 112.

Of course, the quality of the second flow path member 112 may be automatically evaluated by using a camera or the like, instead of the visual inspection by a worker.

Further, according to the configuration of this embodiment, since the non-defective second flow path member 112 is reliably used in the ink jet recording apparatus 101, a defect in which ink leaks from the second flow path member 112 when the ink jet recording apparatus 101 is used for a long period of time is suppressed, and the reliability of the ink jet recording apparatus 101 is improved.

3. Embodiment 3

In the first flow path member 111 according to Embodiment 2, the mark 127 serving as a sign is formed on the thick portion 126 of the insertion portion 122. In a first flow path member 111A according to Embodiment 3, the mark 127 serving as a sign is not formed on the thick portion 126 of an insertion portion 122A.

This point is a main difference between this embodiment and Embodiment 2.

Hereinafter, an overview of the first flow path member 111A according to this embodiment will be described focusing on the differences from Embodiment 2 with reference to FIG. 22. Further, the same configurations as those of Embodiment 2 will be denoted by the same reference numerals, and overlapping description will be omitted.

Figure 22:
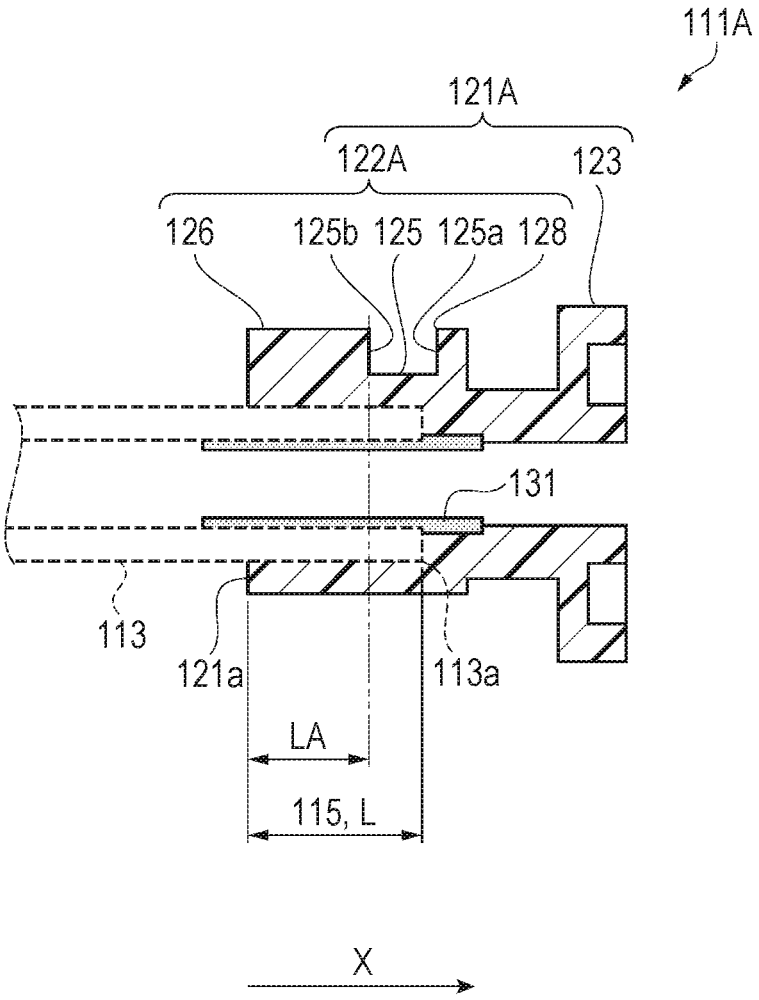
FIG. 22 is a sectional view of a main section of a first flow path member according to Embodiment 3.

As shown in FIG. 22, the first flow path member 111A according to this embodiment has the flexible tube 113, a first molded body 121A serving as a first joint member, and the tubular body 131. The first molded body 121A has an insertion portion 122A into which the flexible tube 113 is inserted, and a connection portion 123 which is connected to the ink cartridge 109. The insertion portion 122A has the thin portion 125 having a thin thickness and the thick portion 126 having a thick thickness. The opening 128 is provided in the thick portion 126, and a worker can visually recognize the flexible tube 113 through the opening 128 and the thin portion 125.

The position in the X direction of the end 125*b* on the −X direction side of the thin portion 125 is different between this embodiment and Embodiment 2, and the position in the X direction of the end 125*a* on the +X direction side of the thin portion 125 is the same. Specifically, in this embodiment, the end 125*b* on the −X direction side of the thin portion 125 is disposed on the +X direction side, as compared with Embodiment 2. Therefore, in this embodiment, the dimension in the X direction of the thin portion 125 is shorter than that in Embodiment 2. Similarly, the dimension in the X direction of the opening 128 is shorter than that in Embodiment 2.

In this embodiment, the end 125*b* on the −X direction side of the thin portion 125 is disposed at the position separated by the distance LA from the end 121*a* on the −X direction side of the first molded body 121A. On the other hand, in Embodiment 2, the base 127*b* of the mark 127 is disposed at the position separated by the distance LA from the end 121*a* on the −X direction side of the first molded body 121A.

In this embodiment, when the end portion 113*a* on the +X direction side of the flexible tube 113 is disposed on the +X direction side with respect to the end 125*b* on the −X direction side of the thin portion 125, in the X direction, the end portion 113*a* on the +X direction side of the flexible tube 113 is disposed at the position separated by the distance LA or more with the end 121*a* on the −X direction side of the first molded body 121A as a reference, and the length L in the X direction of the portion 115 of the flexible tube 113, which is in to contact with the first molded body 121A, becomes equal to or greater than the distance LA. In this case, the adhesive strength between the first molded body 121A and the flexible tube 113 becomes strong, and thus even if the flexible tube 113 is repeatedly bent or extended, the adhesion between the first molded body 121A and the flexible tube 113 is maintained and the adhesion between the first molded body 121A and the flexible tube 113 is not easily released.

Thar is, when the first molded body 121A is properly formed integrally with the flexible tube 113, the end portion 113*a* on the +X direction side of the flexible tube 113 is disposed on the +X direction side with respect to the end 125*b* on the −X direction side of the thin portion 125. Further, when the end portion 113*a* on the +X direction side of the flexible tube 113 is disposed on the +X direction side with respect to the end 125*b* on the −X direction side of the thin portion 125, the flexible tube 113 can be visually recognized through the thin portion 125.

On the other hand, when the first molded body 121A is not properly formed integrally with the flexible tube 113, the end portion 113*a* on the +X direction side of the flexible tube 113 is disposed on the −X direction side with respect to the end 125*b* on the −X direction side of the thin portion 125. When the end portion 113*a* on the +X direction side of the flexible tube 113 is disposed on the −X direction side with respect to the end 125*b* on the −X direction side of the thin portion 125, the flexible tube 113 cannot be visually recognized through the thin portion 125.

Therefore, if a worker visually recognizes the flexible tube 113 through the thin portion 125, it is possible to determine that the first molded body 121A is properly formed integrally with the flexible tube 113 and determine that the first flow path member 111A is a non-defective product. Further, if a worker cannot visually recognizes the flexible tube 113 through the thin portion 125, it is possible to determine that the first molded body 121A is not properly formed integrally with the flexible tube 113 and determine that the first flow path member 111A is a defective product.

In this manner, this embodiment has a configuration in which when the first molded body 121A is properly formed integrally with the flexible tube 113, the flexible tube 113 can be visually recognized through the thin portion 125 (the visual recognition portion).

In this embodiment, a worker can easily and reliably evaluate the quality of the first flow path member 111A by a simple visual inspection to confirm whether the flexible tube 113 can be visually recognized through the thin portion 125 or the flexible tube 113 cannot be visually recognized through the thin portion 125, reliably select the non-defective product of the first flow path member 111A, and reliably exclude the defective product of the first flow path member 111A.

Of course, the quality of the first flow path member 111A may be automatically evaluated by using a camera or the like, instead of the visual inspection by a worker.

Then, since the non-defective first flow path member 111A is reliably used in the ink jet recording apparatus 101, the same effect as Embodiment 2 in which the reliability of the ink jet recording apparatus 101 is improved can be obtained.

The above embodiments can be modified and implemented as follows. The above embodiments and the following modification examples can be implemented in combination with each other within a technically consistent range.

In the above embodiments, the thin portions 125 and 144 as the visual recognition portions that allow the flexible tube 113 to be visually recognized may have transparency. Further, the first molded bodies 121 and 121A and the second joint member 141 may be made of a material having transparency. Here, the term "transparent" means that when a transparent portion is visually recognized, the side opposite to the transparent portion can be seen through the transparent portion. In this way, since it becomes easier to visually confirm the state of the connection portion between the first molded body 121 or 121A and the flexible tube 113 and the state of the connection portion between the second joint member 141 and the flexible tube 113, a concern that a flow path member having a defect in each connection portion may be used is suppressed.

The shape of the mark 119 which is formed on the outer peripheral surface 116 of the flexible tube 113 is not limited to a line shape, and may be a spiral shape, an arrow shape, a number, or a symbol corresponding to the color of ink. For example, a symbol C may be formed as the mark 119 on the flexible tube 113C in which cyan ink flows, and a symbol M may be formed as the mark 119 in the flexible tube 113M in which magenta ink flows, a symbol Y may be formed as the mark 119 on the flexible tube 113Y through which yellow ink flows, and a symbol K may be formed as the mark 119 on the flexible tube 113K through which black ink flows.

Further, instead of forming the mark 119 having the same color as ink color on the flexible tube 113, the flexible tube 113 may be made of resin having the same color as ink color and the mark 119 may be deleted.

The mark 119 does not need to be provided on the entire region in the longitudinal direction of the flexible tube 113, and it is favorable if it is provided on at least the end portions 113*a* and 113*b* of the flexible tube 113, which are covered by the covering portion.

The mark 119 is not limited to being formed on the outer peripheral surface 116 of the flexible tube 113, and the marks 119 may be formed on the end surfaces 114*a* and 114*b* of the flexible tube 113. That is, the flexible tube 113 may have, as marks, colored portions that are colored on the end surfaces 114*a* and 114*b*, instead of or in addition to the line-shaped marks 119. Since both the first molded body 121 and the flexible tube 113 are white, if the flexible tube 113 has colored portions of a color different from white on the end surfaces 114*a* and 114*b*, it becomes easy for a worker to properly determine the quality of the first flow path member 111 by grasping the position of the flexible tube 113 by the colored portions.

Further, when a plurality of flexible tubes 113 are provided, the color of the colored portion may be different for each of the plurality of flexible tubes 113. In this way, the color of ink flowing in the flexible tube 113 can be found out at a glance by the colored portion, and therefore, for example, it becomes easy to correctly route the flexible tube 113 to an intended portion in the casing 102. Further, it is possible to prevent the flexible tubes 113 from being mistaken in order when assembled with the first molded body 121.

In Embodiment 2, the shape of the mark 127 is not limited to a triangle. The mark 127 here is only for confirming whether or not the position of the end surface 114*a* of the flexible tube 113 is at a correct position, and therefore, any mark can be adopted as long as it can realize this. Further, in order to prevent a mistake in the order of the flexible tubes 113, a character relating to the color of ink flowing through the corresponding flexible tube 113 may be used as the mark 127.

In the above embodiments, the four flexible tubes 113 are inserted into the first molded body 121 or 121A. However, instead of this, a single multiple-type flexible tube 113 in which four flow paths are provided side by side may be inserted into the first molded body 121 or 121A. Also in this case, the same effects as those in the above embodiments can be obtained. Further, the number of flow paths which are provided in the multiple-type flexible tube is not limited to four and may be three or less, or five or more. Further, when the multiple-type flexible tube is adopted, the visual recognition portions may be provided only at two positions of both ends such that both ends in the direction in which the flow path is arranged can be visually recognized.

According to the configuration of the flow path member 110, the first molded bodies 121 or 121A may be provided at both ends of the four flexible tubes 113, and the second joint members 141 and the second molded bodies 142 may be provided at both ends of the four flexible tubes.

The visual recognition portion may be provided only on one surface of the thick portion 126 in the first molded body 121 or 121A, as shown in the above embodiments, or may be provided on both surfaces of the thick portion 126.

The flow path members 111, 111A, and 112 according to the above embodiments are not limited to being applied to the ink jet recording apparatus 101, and may be applied to other electronic devices in which a liquid flows.

The technical ideas and the effects thereof which are gasped from the embodiments and modification examples described above will be described below.

A. A mounting unit includes a mounting portion to which a liquid container that accommodates a liquid is mounted, in which the mounting portion has a liquid introduction portion that is inserted into the liquid container that is mounted to the mounting portion, and a first receiving portion that is provided below the liquid introduction portion, the first receiving portion has a first recess portion and a second recess portion, the liquid introduction portion extends in a direction opposite to a mounting direction that is a direction in which the liquid container moves when the liquid container is mounted to the mounting portion, and the second recess portion is provided at a position closer to a tip of the liquid introduction portion than the first recess portion is in the mounting direction.

When the liquid container is mounted to the mounting portion, there is a case where the liquid leaking from the liquid container, so-called liquid leakage, occurs, for example, due to defective insertion of the liquid introduction portion into the liquid container. Further, when the liquid container is being mounted to or dismounted from the mounting portion, there is a case where a small amount of liquid dripping from the liquid container, so-called liquid dripping, occurs due to insertion or extraction of the liquid introduction portion into or from the liquid container. The first receiving portion receives such a liquid.

If the liquid leakage occurs when the liquid container is mounted to the mounting portion, since the liquid container is inserted into the liquid introduction portion, the liquid falls from the position closer to the base end of the liquid introduction portion to the first receiving portion. That is, the liquid due to the liquid leakage falls to the position closer to the base end of the liquid introduction portion with respect to the first receiving portion. As a result, the liquid due to the liquid leakage is received in the first recess portion.

When the liquid container is being mounted to or dismounted from the mounting portion, the liquid container is located at the position where it is pulled out from the liquid introduction portion, as compared with when the liquid container is mounted to the mounting portion. Therefore, if the liquid dripping occurs when the liquid container is being mounted to or dismounted from the mounting portion, the liquid falls from the position closer to the tip of the liquid introduction portion to the first receiving portion. That is, the liquid due to the liquid dripping falls to the position closer to the tip of the liquid introduction portion with respect to the first receiving portion. As a result, the liquid due to the liquid dripping is received in the second recess portion.

As described above, the first receiving portion has the first recess portion that receives the liquid due to the liquid leakage, and the second recess portion that receives the liquid due to the liquid dripping. According to the above configuration, for example, by confirming whether the first recess portion receives the liquid or the second recess portion receives the liquid, it is possible to distinguish between the liquid leakage and the liquid dripping.

B. The above mounting unit may further include a slider, in which the slider may have a receiver that is located between the liquid introduction portion and the first receiving portion in a vertical direction and receives the liquid, and a discharge portion that discharges the liquid received by the receiver to the first receiving portion, the discharge portion moves between a first position where the discharge portion vertically overlaps the first recess portion, and a second position where the discharge portion vertically overlaps the second recess portion, the discharge portion is located at the first position when the liquid container is mounted to the mounting portion, and the discharge portion is located at the second position when the liquid container is not mounted to the mounting portion.

According to the above configuration, the liquid due to the liquid leakage and the liquid due to the liquid dripping are first received in the receiver. The liquid received in the receiver is discharged to the first receiving portion through the discharge portion. In this manner, the liquid due to the liquid leakage and the liquid due to the liquid dripping are received in the first receiving portion.

When the liquid container is mounted to the mounting portion, since the discharge portion and the first recess portion vertically overlap each other, the liquid due to liquid leakage is discharged to the first recess portion. When the liquid container is not mounted to the mounting portion, that is, when the liquid container is being mounted to or dismounted from the mounting portion, since the discharge portion and the second recess portion vertically overlap each other, the liquid due to the liquid dripping is discharged to the second recess portion. Therefore, in the first receiving portion, the portion that receives the liquid due to the liquid leakage and the portion that receives the liquid due to the liquid dripping can be separated. Therefore, by confirming whether the first recess portion receives the liquid or the second recess portion receives the liquid, it is possible to distinguish between the liquid leakage and the liquid dripping.

C. In the above mounting unit, each of the first recess portion and the second recess portion may have a groove.

According to the above configuration, the liquid received by the first receiving portion can be guided by the groove.

D. In the above mounting unit, the first receiving portion may have a discharge port for discharging the liquid received by the first recess portion from the first receiving portion.

It is estimated that the amount of liquid which is received by the first recess portion when the liquid leakage occurs is larger than the amount of liquid which is received by the second recess portion when the liquid dripping occurs. Therefore, according to the above configuration, by discharging the liquid received by the first recess portion from the first receiving portion through the discharge port, it is possible to reduce a concern that the liquid may overflow from the first receiving portion.

E. The above mounting unit may further include a detecting portion that detects the liquid, and a guide path for guiding the liquid discharged from the discharge port to the detecting portion.

According to the above configuration, the guide path guides the liquid received by the first recess portion to the detecting portion, whereby the detecting portion can detect the liquid received by the first recess portion. In this way, the liquid leakage can be detected.

F. The above mounting unit may further include a second receiving portion that receives the liquid discharged from the discharge port, in which volume of the second receiving portion may be larger than volume of the first receiving portion.

According to the above configuration, the liquid received by the first recess portion can be held by the second receiving portion. In this way, a concern that the liquid may leak from the mounting unit can be reduced.

G. The above mounting unit may further include a detecting portion that detects the liquid, in which the detecting portion may be provided in the first recess portion.

According to the above configuration, the detecting portion detects the liquid received by the first recess portion, whereby the liquid leakage can be detected.

H. In the above mounting unit, the first receiving portion may have an absorber that absorbs the liquid at a position that is in contact with the second recess portion.

According to the above configuration, the liquid received by the second recess portion is absorbed by the absorber. In this way, a concern that the liquid due to the liquid dripping may overflow from the first receiving portion can be reduced.

I. A liquid ejection apparatus includes the above mounting unit, and a liquid ejection head that ejects a liquid accommodated in the liquid container mounted to the mounting portion.

According to the above configuration, the same effect as that of the mounting unit can be obtained.

What is claimed is:

1. A mounting unit comprising:

a mounting portion to which a liquid container that accommodates a liquid is mounted, wherein the mounting portion has a liquid introduction portion that is inserted into the liquid container that is mounted to the mounting portion, and a first receiving portion that is provided below the liquid introduction portion, the first receiving portion has a first recess portion and a second recess portion, the liquid introduction portion extends in a direction opposite to a mounting direction that is a direction in which the liquid container moves when the liquid container is mounted to the mounting portion, the second recess portion is provided at a position closer to a tip of the liquid introduction portion than the first recess portion is in the mounting direction, and the first recess portion does not vertically overlap the second recess portion.

2. The mounting unit according to claim 1, further comprising:

a slider, wherein the slider has a receiver that is located between the liquid introduction portion and the first receiving portion in a vertical direction and receives the liquid, and a discharge portion that discharges the liquid received by the receiver to the first receiving portion, the discharge portion moves between a first position where the discharge portion vertically overlaps the first recess portion, and a second position where the discharge portion vertically overlaps the second recess portion, the discharge portion is located at the first position when the liquid container is mounted to the mounting portion, and the discharge portion is located at the second position when the liquid container is not mounted to the mounting portion.

3. The mounting unit according to claim 1, wherein each of the first recess portion and the second recess portion has a groove.

4. The mounting unit according to claim 1, wherein the first receiving portion has a discharge port for discharging the liquid received by the first recess portion from the first receiving portion.

5. The mounting unit according to claim 4, further comprising:

a detecting portion that detects the liquid; and a guide path for guiding the liquid discharged from the discharge port to the detecting portion.

6. The mounting unit according to claim 4, further comprising:

a second receiving portion that receives the liquid discharged from the discharge port, wherein volume of the second receiving portion is larger than volume of the first receiving portion.

7. The mounting unit according to claim 6, further comprising:

a detecting portion that detects the liquid, wherein the detecting portion is provided in the first recess portion.

8. The mounting unit according to claim 1, wherein the first receiving portion has an absorber that absorbs the liquid at a position that is in contact with the second recess portion.

9. A liquid ejection apparatus, comprising:

the mounting unit according to claim 1; and a liquid ejection head that ejects a liquid accommodated in the liquid container mounted to the mounting portion.

10. A liquid ejection apparatus, comprising:

the mounting unit according to claim 1;

a liquid ejection head that ejects a liquid; and a flow path member for communicating the mounting portion and the liquid ejection head, wherein the flow path member has a flexible tube, and a first molded body provided at least one end of the flexible tube, the first molded body has a covering portion that covers an end portion of the flexible tube, and the covering portion has a visual recognition portion in which a position of the end portion is visually recognized.

11. The mounting unit according to claim 1, wherein the first receiving portion is a single tray member and the first and second recess portions are recessed downward in a surface of the single tray member.

12. A mounting unit comprising:

a mounting portion to which a liquid container that accommodates a liquid is mounted; and a slider, wherein the mounting portion has a liquid introduction portion that is inserted into the liquid container that is mounted to the mounting portion, and a first receiving portion that is provided below the liquid introduction portion, the first receiving portion has a first recess portion and a second recess portion, the liquid introduction portion extends in a direction opposite to a mounting direction that is a direction in which the liquid container moves when the liquid container is mounted to the mounting portion, the second recess portion is provided at a position closer to a tip of the liquid introduction portion than the first recess portion is in the mounting direction, the slider has a receiver that is located between the liquid introduction portion and the first receiving portion in a vertical direction and receives the liquid, and a discharge portion that discharges the liquid received by the receiver to the first receiving portion, the discharge portion moves between a first position where the discharge portion vertically overlaps the first recess portion, and a second position where the discharge portion vertically overlaps the second recess portion, the discharge portion is located at the first position when the liquid container is mounted to the mounting portion, and the discharge portion is located at the second position when the liquid container is not mounted to the mounting portion.

* * * * *